US006361077B1

(12) United States Patent
Petkovsek

(10) Patent No.: US 6,361,077 B1
(45) Date of Patent: Mar. 26, 2002

(54) LABEL AND/OR FORM FOR SPECIAL SERVICE MAILING AND A METHOD OF ASSEMBLING A MAILPIECE REQUIRING SPECIAL MAILING SERVICES

(76) Inventor: Glenn Petkovsek, 2 Saverne Cir., Little Rock, AR (US) 72223

( * ) Notice: Subject to any disclaimer, the term of this patent is extended or adjusted under 35 U.S.C. 154(b) by 0 days.

(21) Appl. No.: 09/413,400

(22) Filed: Oct. 6, 1999

Related U.S. Application Data

(63) Continuation-in-part of application No. 08/923,147, filed on Sep. 4, 1997, now abandoned, which is a continuation-in-part of application No. 08/714,679, filed on Sep. 16, 1996, now Pat. No. 6,089,613, which is a continuation-in-part of application No. 08/281,634, filed on Jul. 28, 1994, now Pat. No. 5,573,277.

(51) Int. Cl.[7] ..... B42D 15/00

(52) U.S. Cl. ..... 283/79; 283/81; 283/103; 283/67; 462/6; 462/26; 229/70; 229/300

(58) Field of Search ..... 283/79, 81, 101, 283/103, 56, 61, 62, 116, 117, 67, 70; 281/2, 5; 229/300, 92.8, 68.1, 70, 314, 315; 40/630, 638; 462/6, 8, 26, 64, 65

(56) References Cited

U.S. PATENT DOCUMENTS

| | | | | |
|---|---|---|---|---|
| 2,074,821 | A | | 3/1937 | Wissmann |
| 2,166,439 | A | | 7/1939 | Johnson |
| 2,270,455 | A | | 1/1942 | Lichter |
| 2,279,164 | A | | 4/1942 | Gettleman |
| 2,805,816 | A | | 9/1957 | Morgan |
| 2,835,434 | A | | 5/1958 | Watson |
| 3,061,173 | A | | 10/1962 | Sawdon |
| 3,164,317 | A | | 1/1965 | Bogen |
| 3,813,028 | A | | 5/1974 | Greason |
| 3,937,492 | A | | 2/1976 | Biron |
| 3,968,927 | A | | 7/1976 | Katz et al. |
| 3,986,662 | A | | 10/1976 | Luftig |
| 4,368,903 | A | | 1/1983 | Jones |
| 4,418,865 | A | | 12/1983 | Bowen |
| 4,429,827 | A | | 2/1984 | Murray |
| 4,682,793 | A | | 7/1987 | Walz |
| 4,809,905 | A | | 3/1989 | Goodman |
| 4,915,287 | A | | 4/1990 | Volk et al. |
| 4,983,428 | A | | 1/1991 | Jameson |
| 5,039,652 | A | | 8/1991 | Doll et al. |
| 5,071,167 | A | | 12/1991 | O'Brien |
| 5,183,203 | A | | 2/1993 | Sanders |
| 5,190,210 | A | | 3/1993 | Walz |
| 5,267,898 | A | | 12/1993 | Doll et al. |
| 5,288,014 | A | | 2/1994 | Meyers et al. |
| 5,316,208 | A | | 5/1994 | Petkovsek |
| 5,383,686 | A | | 1/1995 | Laurash |
| 5,397,052 | A | * | 3/1995 | Walz ..... 229/300 |
| 5,413,383 | A | | 5/1995 | Laurash et al. |
| 5,486,021 | A | | 1/1996 | Laurash |
| 5,501,393 | A | | 3/1996 | Walz |
| 5,507,526 | A | | 4/1996 | Petkovsek |
| 5,547,227 | A | | 8/1996 | Laurash et al. |
| 5,573,277 | A | | 11/1996 | Petkovsek |
| 5,626,286 | A | | 5/1997 | Petkovsek |
| 5,626,370 | A | * | 5/1997 | Petkovsek ..... 283/116 |
| 5,697,648 | A | * | 12/1997 | Petkovsek ..... 281/2 |
| 5,836,622 | A | | 11/1998 | Fabel |
| 6,089,613 | A | * | 7/2000 | Petkovsek ..... 283/79 |

FOREIGN PATENT DOCUMENTS

| | | |
|---|---|---|
| CA | 263010 | 10/1976 |

* cited by examiner

*Primary Examiner*—Willmon Fridie, Jr.
(74) *Attorney, Agent, or Firm*—Patents +TMS

(57) ABSTRACT

A label/form is provided for effecting delivery of a mailpiece by a special service. The label/form contains detachable parts for subsequent attachment to a return postcard and/or a mailpiece to effect delivery of the mailpiece by the special service. Further, a plurality of auxiliary labels are provided. The auxiliary labels correspond to address labels, receipt labels and/or a special service designator section. A second special services designator section may be provided to give the sender of the mailpiece a choice between two or more special services.

20 Claims, 16 Drawing Sheets

LABEL AND/OR FORM FOR SPECIAL SERVICE MAILING AND A METHOD OF ASSEMBLING A MAILPIECE REQUIRING SPECIAL MAILING SERVICES

This application is a continuation-in-part of U.S. patent application Ser. No. 08/923,147, filed on Sep. 4, 1997, now abandoned, which is a continuation-in-part application of U.S. patent application Ser. No. 08/714,679 filed on Sep. 16, 1996, now U.S. Pat. No. 6,089,613, which is a continuation-in-part of U.S. patent application Ser. No. 08/281,634, filed Jul. 28, 1994 issued as U.S. Pat. No. 5,573,277 on Nov. 12, 1996.

BACKGROUND OF THE INVENTION

The present invention generally relates to a form for printing address information relating to mail handling for attachment to a mailpiece. More specifically, the present invention relates to a multi-part form for special service handling of mailpieces or for mailpieces requiring special services.

It is, of course, known to provide specialized postal processing and handling of particular mailpieces. Such special services include the preparation of certified mail, registered mail, insured mail, recorded delivery mail, return receipt for merchandise mail, C.O.D. and the like. The known procedure requires printing or writing of information on various slips of paper and attaching the slips to the outside of an envelope or other mailpiece. Often carbon paper is used to assist in making the attachments.

As an example, to prepare a certified mailpiece, the forms are supplied by the United States Postal Service to the customer. The customer must separately address and complete a certified mailing receipt, both faces of a return receipt card, an envelope or mailpiece in which the mail is to be mailed, and a request for return service on the face of the envelope. Then, the customer or the Postal Service must affix each of the completed parts to the envelope using glue, an adhesive, tape or the like.

In U.S. Pat. No. 4,682,793 to Walz, a multiple-part mailer form assembly is shown in which the addressing of specialized postal handling may be accomplished by continuously fed impact-type printers. The parts are then separated from each other for affixing some parts to the outside of a standard window envelope which can be addressed by the insertion of one of the extra form layers.

This type of multiple-layer continuous assembly cannot be addressed or overprinted in the non-impact printers as commonly used or on less expensive impact-type printers having no means to adjust for strength of impact or thickness of multiple-layer forms. Furthermore, the address information printed on the intermediate or rear layers of such forms is often degraded or blurred to a less readable condition by the necessity of printing through the multiple layers. The degradation renders the use of bar codes unfeasible on the lower layers of the address inserts to be compatible with U.S. Postal Service sorting equipment which is now generally used. Further, the degradation renders unfeasible the use of high-density bar codes in other forms for automated identification of the return receipt postal card when returned to the sender as proof of delivery to the addressee.

Still further, the multiple-part mailer disclosed by Walz requires forms to be separately affixed to the outside of the envelope or other mailpiece by using glue, adhesive, tape, or the like. The form includes a significant amount of carrier, backing, carbon layer, peel-off or other materials which require handling and removal during use and subsequent discarding as waste after use. Further, chemical treatment of some of the layers of the form is also required during manufacturing of the form.

Still further, the mailer disclosed by Walz is not suitable for feeding through automatic non-impact printers and, therefore, the return address of the sender must be printed on the back of the return receipt card portion of the form by non-impact means, i.e. either hand-printing or labeling or offset printing during the manufacturing process. This avoids unwanted reverse printing on the face of the other layers. Finally, the mailer of Walz does not disclose a means for noting the request for return receipt service, if desired, on the face of the envelope as required by postal regulations.

Clearly, the current methods known for preparing mailpieces or shipping items for special services is tedious, complicated, and labor intensive, particularly for businesses and institutions in which items such as notifications, reminders, or valuable documents are commonly sent by specialized mail services. In many instances, the delivery of such mailpieces must be documented by recording of a U.S. Postal Service receipt or other services return receipt when it arrives back to the sender. This task is also time consuming and has great potential for error when all of the identifying information from each return receipt card must be entered or recorded by hand.

A need, therefore, exists for an improved form for special service mail and shipping handling and a method for assembling a mailpiece or shipping item requiring special services.

SUMMARY OF THE INVENTION

The present invention provides a label/form that may be printed on two sides wherein portions of the label/form are attached to a sheet and including an adhesive on its back for attaching the same to a mailpiece or shipping item. Another portion of the sheet is detachable from the label/form for securing to the mailpiece and, subsequently, for removing from the mailpiece or shipping item.

To this end, in an embodiment of the present invention, an assembly for shipping and handling an article requiring delivery by a special service is provided. The assembly has a first sheet having a first label wherein the first label has information related to the delivery of the article wherein the first label attaches to a return postcard. An auxiliary label is provided on the assembly. A backing layer is disposed on a backside of the first layer.

In an embodiment, an adhesive layer is disposed between the first layer and the backing layer.

In an embodiment, the first label has information that corresponds to U.S. Postal Service Form 3811.

In an embodiment, the auxiliary label corresponds to a receipt for the delivery of the article by the special service.

In an embodiment, the auxiliary label corresponds to an address label for the delivery of the article by the special service.

In an embodiment, a special services designator section is provided on the assembly.

In an embodiment, a receipt and a special services designator section wherein the receipt is removably attached to the special services designator section are provided.

In an embodiment, a second sheet is attached to the first sheet wherein the second sheet contains a second label for attachment to a second return postcard.

In another embodiment of the present invention, a form for special service delivery of a mailpiece is provided. The form has a first layer having an information section for attachment to a special services return postcard wherein the information section has information related to the special service. The information section is removably attached to a remainder of the label/form. A backing layer is disposed on a backside of the first layer. A first special services designator section is provided on the form and a second special services designator section is provided on the form.

In an embodiment, an auxiliary label is removably attached to the backing sheet.

In an embodiment, the information section is removably attached to the backing sheet.

In an embodiment, a receipt section is removably attached to the first layer.

In an embodiment, the information section includes an area for designating the special service delivery desired by a sender of the mailpiece.

In an embodiment, the first special services designator section is removably attached to the backing sheet via a tear line.

In an embodiment, an adhesive is provided between the first layer and the backing sheet.

In an embodiment, the first special services designator section is removably attached to the receipt section.

In another embodiment of the present invention, a method for preparing a mailpiece for delivery by a special service is provided. The method comprises the steps of: providing a form having a first layer wherein the first layer has an information section; providing a backing layer disposed on a backside of the first layer wherein the information section is removably attached to the backing layer; printing information related to the delivery of the mailpiece by the special service on the first layer; providing a return postcard; removing the information section from the form; and attaching the information section to the return postcard.

In an embodiment, the method includes providing an auxiliary label removably attached to the backing and removing the auxiliary label from the backing sheet.

In an embodiment, the method includes attaching the auxiliary label to the mailpiece to effect delivery of the mailpiece by the special service.

In an embodiment, the method includes providing a special services designator section on the form; removing the special services designator section from the form; and attaching the special services designator section to the mailpiece to effect delivery of the mailpiece by the special service.

It is, therefore, an advantage of the present invention to provide a label/form and a method for simplified assembly of a mailpiece or shipping item requiring special services.

Another advantage of the present invention is to provide a label/form and a method for identifying the type of special service by removal of a portion of the label/form from a sheet and subsequent attachment to a mailpiece or shipping item.

Yet another advantage of the present invention is to provide a label/form and a method for assembly of a mailpiece or shipping item requiring special services such that the label/form and the method can be quickly performed.

A still further advantage of the present invention is to provide a label/form and a method for assembling a mailpiece or shipping item using the label/form without requiring additional means for securing the label/form to the mailpiece or shipping item.

Another advantage of the present invention is to provide a label/form that simplifies identification of particular sections thereof for both machine readability and visible identification.

Yet another advantage of the present invention is to provide a label/form for use on mailpieces or shipping items requiring special services that includes printing unique to the mailpiece or shipping item on only one side of the label/form.

And, another advantage of the present invention is to provide a label/form for use on mailpieces or shipping items requiring special services which is sized to occupy only one-half of an 8½ inch backing sheet wherein two such label/forms may be affixed to a single backing sheet.

A further advantage of the present invention is to provide a label/form for use on mailpieces or shipping items requiring special services which is sized so as to fit on a single side of a standard 4⅛ inch by 9½ inch envelope for mailing purposes.

Another advantage of the present invention is to provide an assembly, a label/form and a method of using the same that provides a plurality of removable labels to be added to a return postcard.

A further advantage of the present invention is to provide an assembly, a label/form and a method of using the same that provides a removable special services label to attach to either a mailpiece or the return postcard.

A still further advantage of the present invention is to provide an assembly, a label/form and a method of using the same that provides a second removable special services label that allows a sender of a mailpiece to have a choice in special services provided on one form.

Moreover, an advantage of the present invention is to provide an assembly, a label/form and a method of using the same that provides two mailing forms together on a single sheet.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

Figure 1:
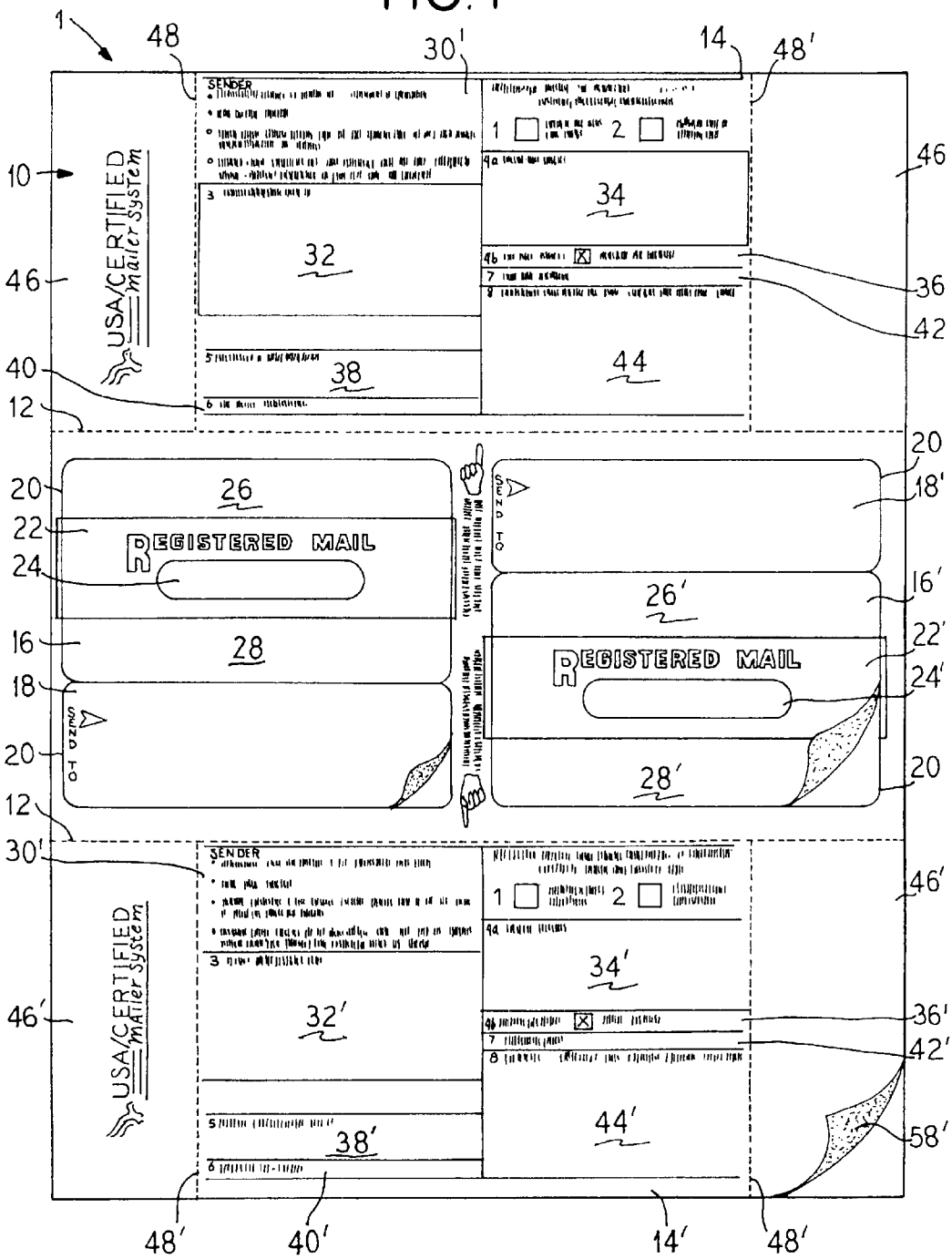
FIG. 1 illustrates a plan view of an embodiment of one side of a label/form for special service mailing/shipping of a mailpiece or shipping item.

Referring now to the drawings, wherein like numerals refer to like parts, a special service mailing label/form is generally illustrated at 1. The label/form 1 consists of a plurality of detachable parts. Some of the parts of the label/form 1 are detachable by tear lines, while other portions of the label/form 1 are attached to the sheet by an adhesive on the back of the portion.

FIG. 1 illustrates a first side 1 of the label form 1. The first side 10 has two sets of detachable parts for satisfying requirements for mailing/shipping of at least one mailpiece or shipping item requiring special services. It should be understood, however, that a particular label/form may be infinite in length satisfying the requirements for any number of mailpieces or shipping items requiring special services. In the alternative, the label/form may be designed such that it satisfies requirements for labeling and special services for a single mailpiece or shipping item. Still further, the label/form illustrated is for registered mail, however, any type of special service mailing or shipping may be satisfied with the present invention, including, but not limited to, registered mail, insured mail, recorded delivery, return receipt for merchandise, C.O.D., etc.

The label/form 1 illustrated in FIG. 1 has the two horizontal perforated tear lines 12 for removal of return receipt card sections 14 and 14' from the remainder of the label/form 1. A second set of parts are adhesively-backed to the label/form 1 for removable attachment to the label/form 1 and subsequent attachment to the mailpiece or shipping item. Service identifier sections 16 and 16' are attached to the label/form 1 by an adhesive backing. Sender identifier sections 18 and 18' are similarly adhesively-backed to the label/form 1. The service identifier sections 16 and 16' and the sender identifier sections 18 and 18' have score lines 20 generally defining each of the sections and for simplified removal of the sections 16, 16', 18 and 18' from the label/form 1.

The service identifier sections 16 and 16' include a first special service identifier 22 and 22', respectively. The special service identifiers 22, 22' may be distinctly colored from the remainder of the service identifier sections 16, 16'. Still further, letters may be imprinted on the service identifier sections 16, 16' indicating the particular type of special service, such as the "REGISTERED MAIL" identifier.

Contrasting colored sections 24, 24' are provided within the special service identifiers 22, 22' of the service identifier sections 16, 16'. The contrasting colored sections 24, 24' may be printed with an identifier such as an article number and/or may be further printed with variable specific instructions as "RETURN RECEIPT REQUESTED" or other imprinting as desired.

Figure 4:
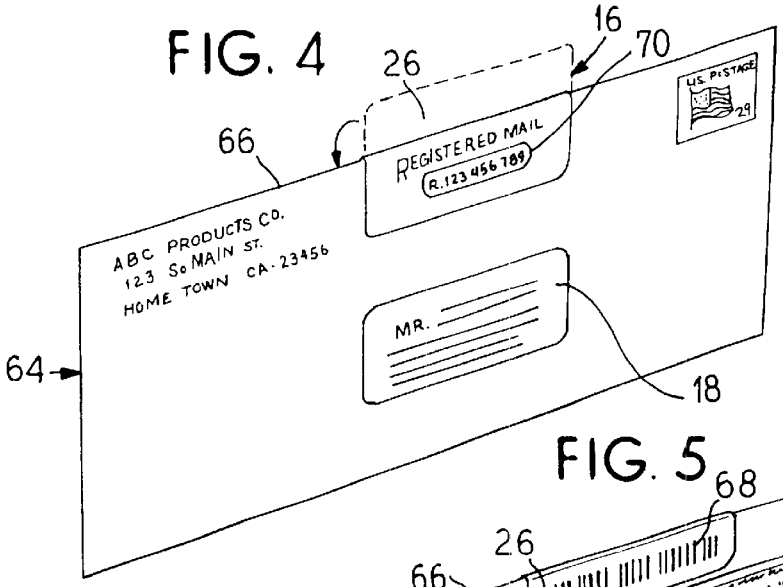
FIG. 4 illustrates a perspective view of an embodiment of one side of a mailpiece or shipping item with attachment of a portion of the label/form required for special service mail or shipment handling of the mailpiece or shipping item.

Top sections 26, 26' and bottom sections 28, 28' are provided on opposite sides of the special service identifiers 22, 22' for additional space for printing in label/formation as desired or, alternatively, may be left unprinted or blank. The top sections 26, 26' are particularly suitable for printing of bar codes, OCR type or other machine-readable images. The top sections 26, 26' are inverted when sealed onto the mailpiece or shipping item (as illustrated in FIG. 4) such that a back side of the mailpiece or shipping item includes the identifier associated with the mailpiece or shipping item.

The return receipt card sections 14, 14' on the first side 10 of the label/form 1 are removably attached to the label/form 1 by the perforated tear lines 12. The return receipt card sections 14, 14' include instruction sections 30, 30', article addressee sections 32, 32', article number or identifier sections 34, 34', service type sections 36, 36', addressee signature sections 38, 38', and agent signature sections 40, 40'. Further, date of delivery sections 42, 42' and addressee's address sections 44, 44' are provided. This particular label/form is suitable for a return receipt card for registered mail and other special service mail and shipping items. Of course, similar type receipt cards capable of providing a return receipt following delivery of the mailpiece or shipping item may be implemented.

Any one or more of the aforementioned sections may be of contrasting color to the main background color of the remainder of the label/form 1. For instance, typically, the background color of the return receipt card sections 14, 14' may be a green shade commonly used for return receipt cards. The identifier sections 34, 34' may have a white background for simplified reading of, for example, a bar code or OCR characters printed thereon. Likewise, the article addressee sections 32, 32' may be printer with a white background for immediate recognition on the label/form 1 of the delivery point of the mailpiece or shipping item carrying the label/form 1. The central portion of the label/form 1 including the service identifier sections 16, 16' and the sender identifier sections 18, 18' may be similarly shaded with contrasting colors for identification and machine readability purposes of the bar codes and/or OCR characters or the like.

Figure 5:
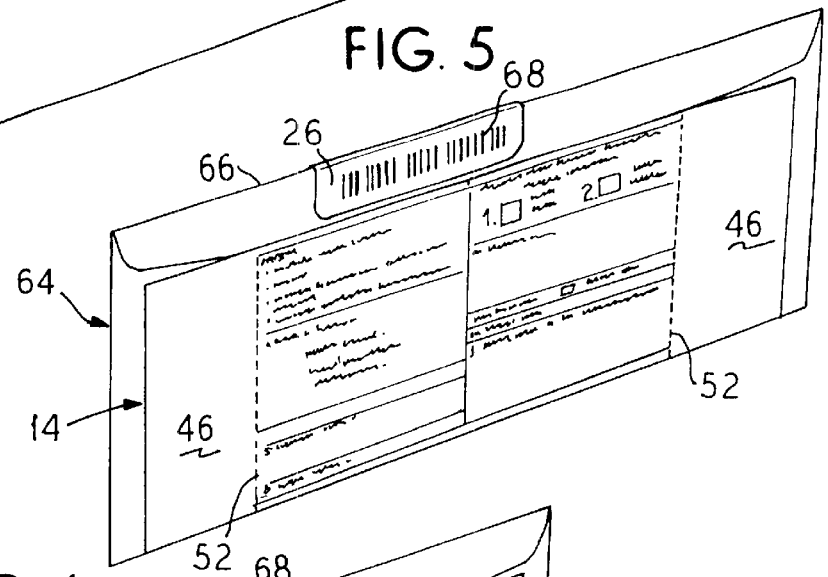
FIG. 5 illustrates a plan view of an embodiment of a second side of a mailpiece or shipping item with a second portion of the label/form required for special service handling of the mailpiece or shipment attached to the mailpiece or shipping item.

Peelable sections 46 and 46' are provided a silicon layer 56' and an adhesive layer 58' for removably detaching the back side of the label/form 1 from the return receipt card and subsequent attachment to the mailpiece or shipping item as illustrated in FIG. 5. To this end, that portion of the return receipt card sections 14, 14' on the fist side 10 of the label/form 1 is attached in its entirety to the mailpiece or shipping item. Vertical perforated lines 52, 52' are provided for subsequent detachment of the return receipt card from the mailpiece or shipping item (as illustrated in FIG. 6).

Figure 2:
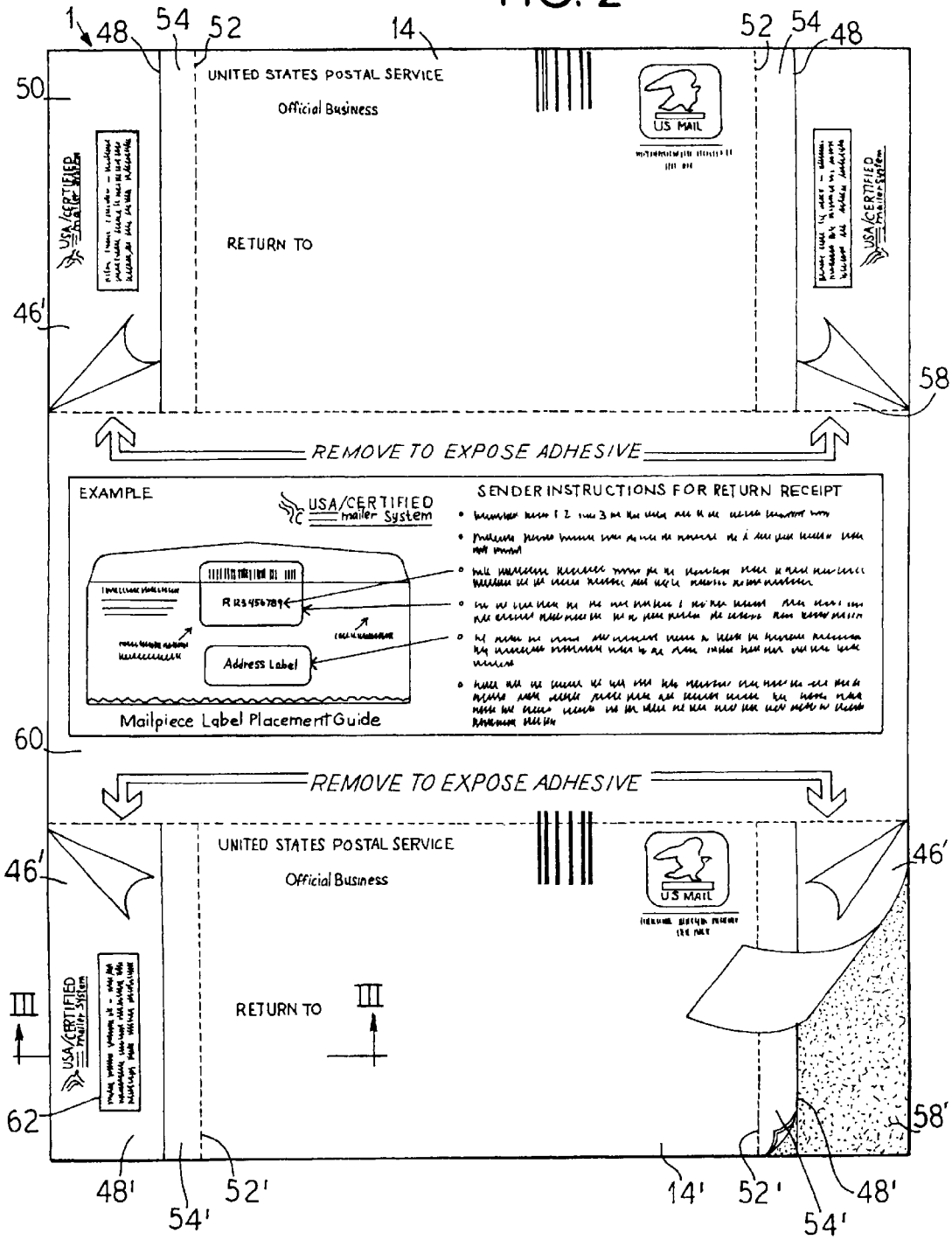
FIG. 2 illustrates a plan view of an embodiment of a second side of a label/form for special service mailing/shipping of a mailpiece or shipping item.
Figure 3:
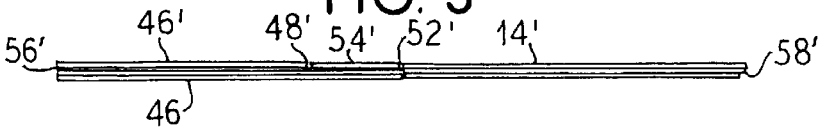
FIG. 3 illustrates a partial cross-sectional view taken generally along the line III—III of FIG. 2.

Referring now to FIG. 2, a back side 50 of the label/form 1 is illustrated. The back side 50 includes front faces of the return receipt card sections 14, 14'. The vertical perforated tear lines 52, 52' are further provided inside of vertical slit lines 48, 48'. The area between the vertical slit lines 48, 48' and the vertical perforated tear lines 52, 52' define typing together sections 54, 54'. The tying together sections 54, 54' include an area having a back having a partial section thereof containing the adhesive layer 58, 58' as illustrated in FIGS. 2 and 3. That is, the adhesive layer 58, 58' from the peelable sections 46, 46' continues into the tying together sections 54, 54' for securing the return receipt card sections 14, 14' thereto.

The adhesive layers 58, 58' are provided to prevent separation of the layers of the return receipt card label/forming the front side and the back side thereof. A central section 60 is provided on the back side 50 including instructions for assembling the label/form onto the mailpiece or shipping item. Additional instructions may be provided on the peelable sections 46, 46' as generally illustrated at 62.

Figure 6:
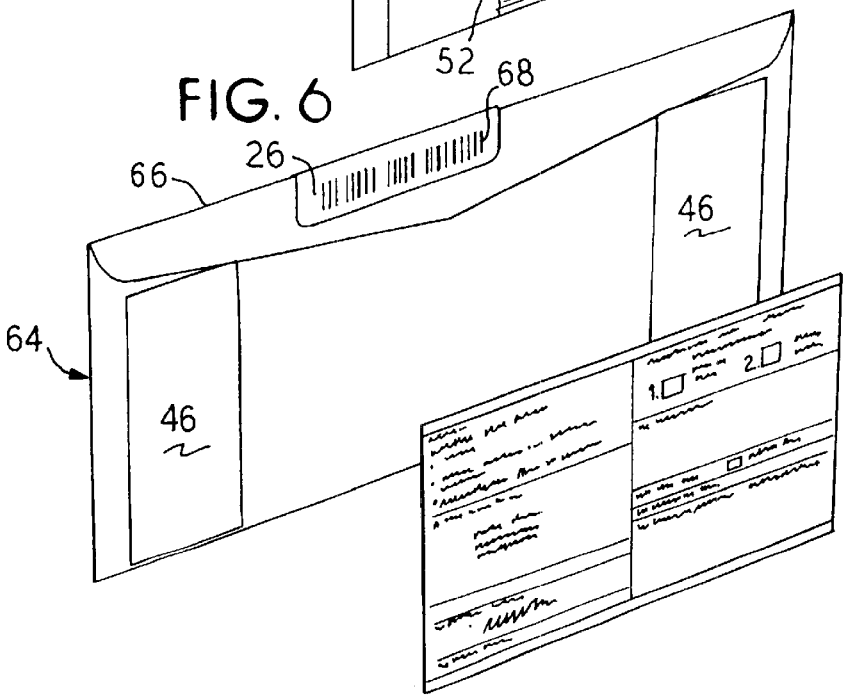
FIG. 6 illustrates a perspective view of an embodiment of a second side of the mailpiece or shipping item with a portion of the second part of the label/form detached from the mailpiece or shipping item.

The assembling of a mailpiece or shipping item 64 with the respective portions of the label/form 1 is more clearly illustrated in FIGS. 4–6. to assemble the mailpiece or shipping item 64, a sender identifier section 18 is first removed from the first side 10 of the label/form 1 and centered onto the mailpiece or shipping item 64. Then, following printing of the requisite information onto each of the individual sections, the service identifier section 16 is attached at a top edge 66 of the mailpiece or shipping item 64. The section of the service identifier section 17 referred to as the top section 26 is inverted to face on the back side of the mailpiece or shipping item 64 as illustrated in FIGS. 5 and 6. The top section 26 may include a machine readable identifier 68 corresponding to the numerical identifier 70 on a front side of the mailpiece or shipping item 64. Then, the return receipt card section 14 may be attached to a back side of the mailpiece or shipping item 64 by removing the peelable sections 46 such that the adhesive layer 58,58' on the underside of the sections 46 is placed on the back side of the mailpiece or shipping item 64. As a result, the return receipt card section 14 is attached to the back side of the mailpiece of shipping item 64.

Following delivery of the mailpiece or shipping item 64, the return receipt card of the return receipt card section 14 may be detached along the vertical perforated tear lines 532 separating the return receipt card from the remainder of the mailpiece or shipping item 64. The peelable sections 46 maintain their adhesion to the back side of the mailpiece or shipping item 64 as shown in FIG. 6.

Figure 7:
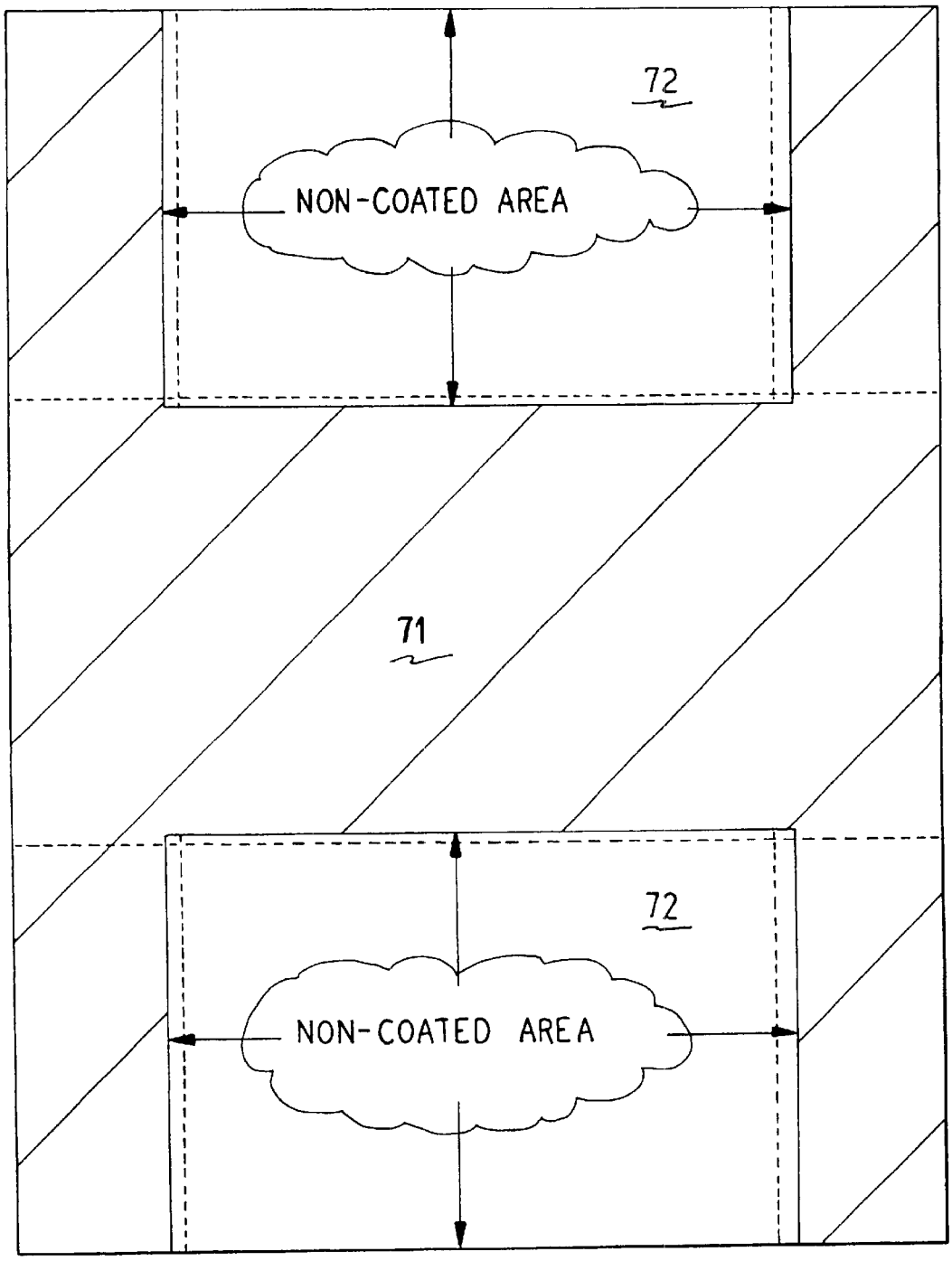
FIG. 7 illustrates a plan view of the label/form of the present invention designating the areas of the label/form having coated and non-coated areas of adhesive.

As illustrated in FIG. 7, the area generally designated at 70 includes the silicone layer 56 or 56' and the adhesive layer 58 or 58', respectively, providing the necessary peelability of layers of the label/form 1. The non-coated areas generally designated at 72 include only the adhesive layer preventing peelability between the layers formed by the front side and the back side of the label/form 1 resulting in formation of the return receipt card 14. The combination of the adhesive layer 58 with the silicone layer 56 also prevents or inhibits migration of the adhesive layer 58 along edges, perforations, and/or slits of the label/form 1.

In yet another alternative embodiment, the label/form 110 consists of a plurality of detachable parts. The parts of the label/form 110 are detachable by tear lines, score lines, perforations or the like.

Figure 8:
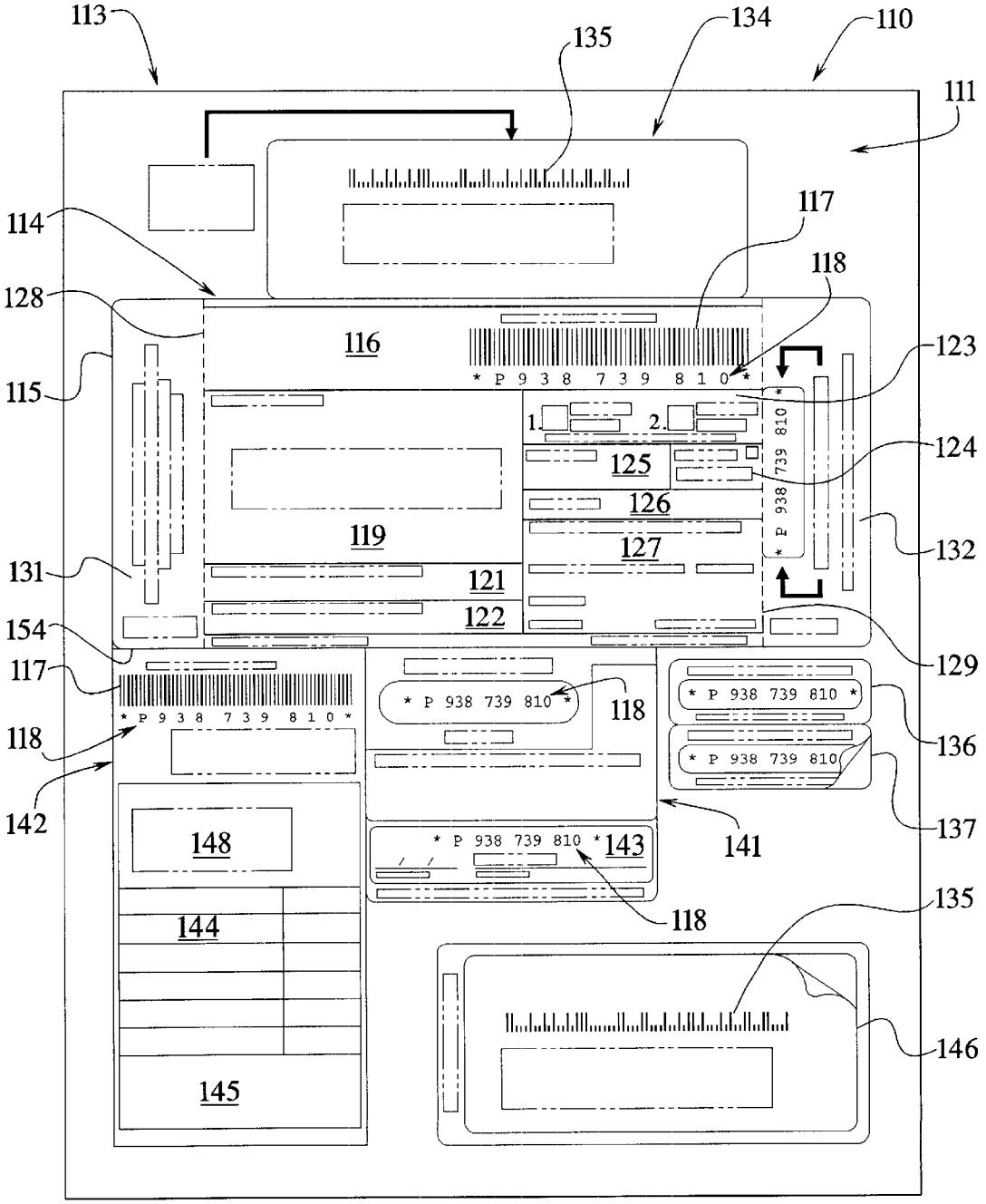
FIG. 8 illustrates a plan view of an embodiment of the front side of a label/form for special service mailing/shipping of a mailpiece or shipping item.
Figure 9:
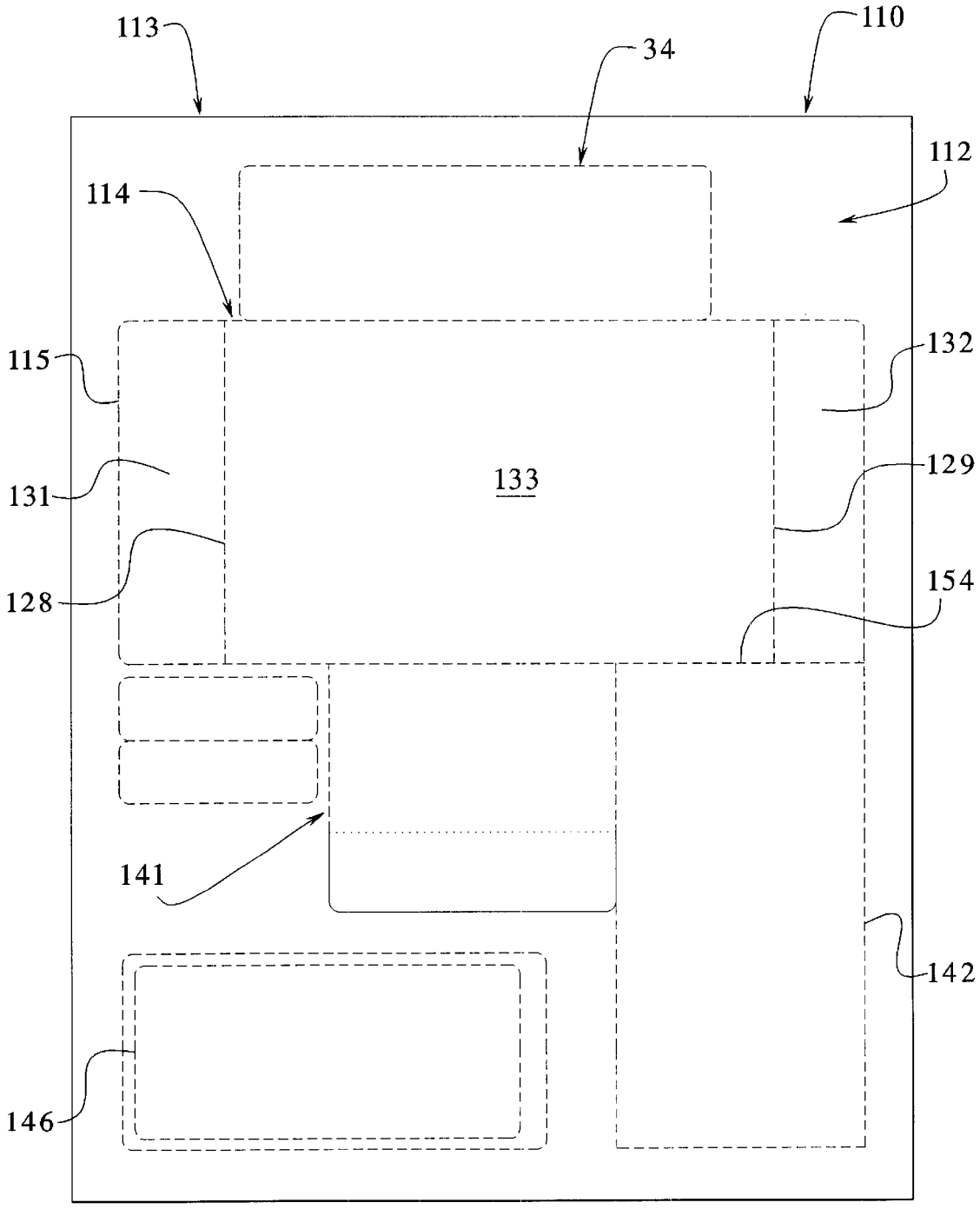
FIG. 9 illustrates a plan view of an embodiment of a back side of a label/form for special service mailing/shipping of a mailpiece or shipping item.

FIG. 8 illustrates a first or a front side 111 of the label/form 110. FIG. 9 illustrates a second or back side 112 of the label/form 110. For purposes of clarity, the side 111 will hereinafter be refereed to as the front side 111, and the side 112 will hereinafter be referred to as the back side 12.

As illustrated in FIG. 8, the front side 111 has one set of detachable parts for satisfying requirements for the mailing/shipping of at least one mailpiece or shipping item requiring special services. It should be understood, however, that a particular label/form may be infinite in length satisfying the requirements for any number of mailpiece or shipping items requiring special services. In the alternative, the label/form may be designed such that it satisfies requirements for labeling and special service a for a single mailpiece or shipping item. Still further, the label/form illustrated is for registered mail; however, any type of special service mailing or shipping may be satisfied with the present invention, including, but not limited to, registered mail, insured mail, recorded delivery, return receipt for merchandise, C.O.D., etc.

The label/form 110 illustrated in FIGS. 8 and 9 comprises a sheet 113 with a plurality of detachable parts that are defined by tear lines, score lines or perforations that extend through the sheet 113, or through the front side 111 to the back side 112 as illustrated in FIGS. 8 and 9. The side of the postcard 114 which is disposed in the front side of the label/form 110 is that which requires the most amount of information specific to the particular article. In order to provide a label/form 110 which requires printing on one side only, such as the front side 111, it is necessary to dispose that side of the postcard 114 which may be printed with the appropriate information relevant to the article being shipped, the sender and the addressee.

Therefore, the postcard 114 includes an article identification section 116 which may include a bar code 117, a number 118 o other suitable means for uniquely identifying the article being shipped. An addressee identification section is provided at 119 on which the name and address of the addressee is pre-printed. A receiver identification section 121 and a receiver signature section 122 are provided to record the name and signature of the person acknowledging receipt of the article.

Additional informational sections are provided to the right of sections 119, 121 and 122 for varying purposes. For example, a special services request section 123 may be provided for requesting special services such as locating the addressee's address or restricting delivery. A service request section 124 may be provided for requesting special services such as certified delivery. An additional article identification section may be provided at 125. A delivery date section may be provided at 126. An address identification request section may be provided at 127 for recording the addressee's address if such a service is provided.

The return postcard 114 includes two perforated score lines 128, 129 which separate the postcard 114 from the two adhesive sections 131,132. The two adhesive sections 131, 132 enable the postcard 114 to be removably attached to the article to be mailed because, as illustrated in FIG. 9, the entire back side 112 of the label/form 110 is coated with adhesive with the exception of the back side 133 of the postcard 114. Thus, the two adhesive sections 131,132 may be affixed to the article to be mailed, and the postcard 114 may be detached from the adhesive sections 131,132 and the article to be mailed by tearing along the tear lines 128,129.

Also illustrated in FIG. 8 is the sender ID section or label 134 which is pre-printed with the sender's address. The label 134 is then folded over and onto the back side 133 of the postcard 114. By providing the sender's address 134 at the front side 111 of the label/form 110, the label 134 may be pre-printed with the other components of the label/form 110 shown in FIG. 8 thereby eliminating any need for pre-printing any component shown on the back side 112 in FIG. 9. Accordingly, all of the information specific to the article being mailed is printed on the front side 111 of the label/form 110 which eliminates the need for any two-sided printing. Accordingly, a preferred embodiment will include a removable backing layer (not shown) which covers the back side 112 of the label/form 110 to protect the adhesive layer.

As illustrated in FIG. 8, the sender address label 134 may also include a bar code 135 or other identification means. Additional article identification labels may be provide at 136,137.

In addition to the sender address label 134 which is preferably attached to the return postcard section 114, a service identification label 141 and a receipt label 142 are also disposed adjacent top, and preferably connected to, the return postcard 114. The service identification label 141 preferably includes a specification of the type of service required (e.g., certified mail) in addition to the article identification number 118 or other article identification means. In addition to the number 118, a bar code may be provided in the label 141. Optionally, a sender identification section may be provided at 143 which again may optionally include the article identification number 118. The receipt label 142 also preferably includes the article identification number 118, the bar code 117 or other suitable identification means. The receipt 142 may also provide an addressee identification section 148, a fee calculation section 144 and a space 145 for indicating the postmark or postage date.

Also illustrated in FIG. 8 is the addressee label section 146. The addressee label section 146 may also include a bar code 135 or other similar identification means.

In a preferred embodiment, the sender address label 134, the return postcard 114 as attached to the adhesive sections 131,132, the service ID label 141 and the receipt label 142 are all detachably connected together as illustrated in FIG. 8. In use, the addressee identification label 146 is removed from the sheet 113 and attached to the front side 153 of the envelope 151. Then, the sender address label 134, the postcard section 114 and adhesive sections 131,132, the service identification label 141 and the receipt label 142 are all pulled off of the sheet 113 as a single piece. The sender address label 134 is then folded over and onto the back side 133 of the postcard 114 as illustrated in FIGS. 9 and 11.

Figure 10:
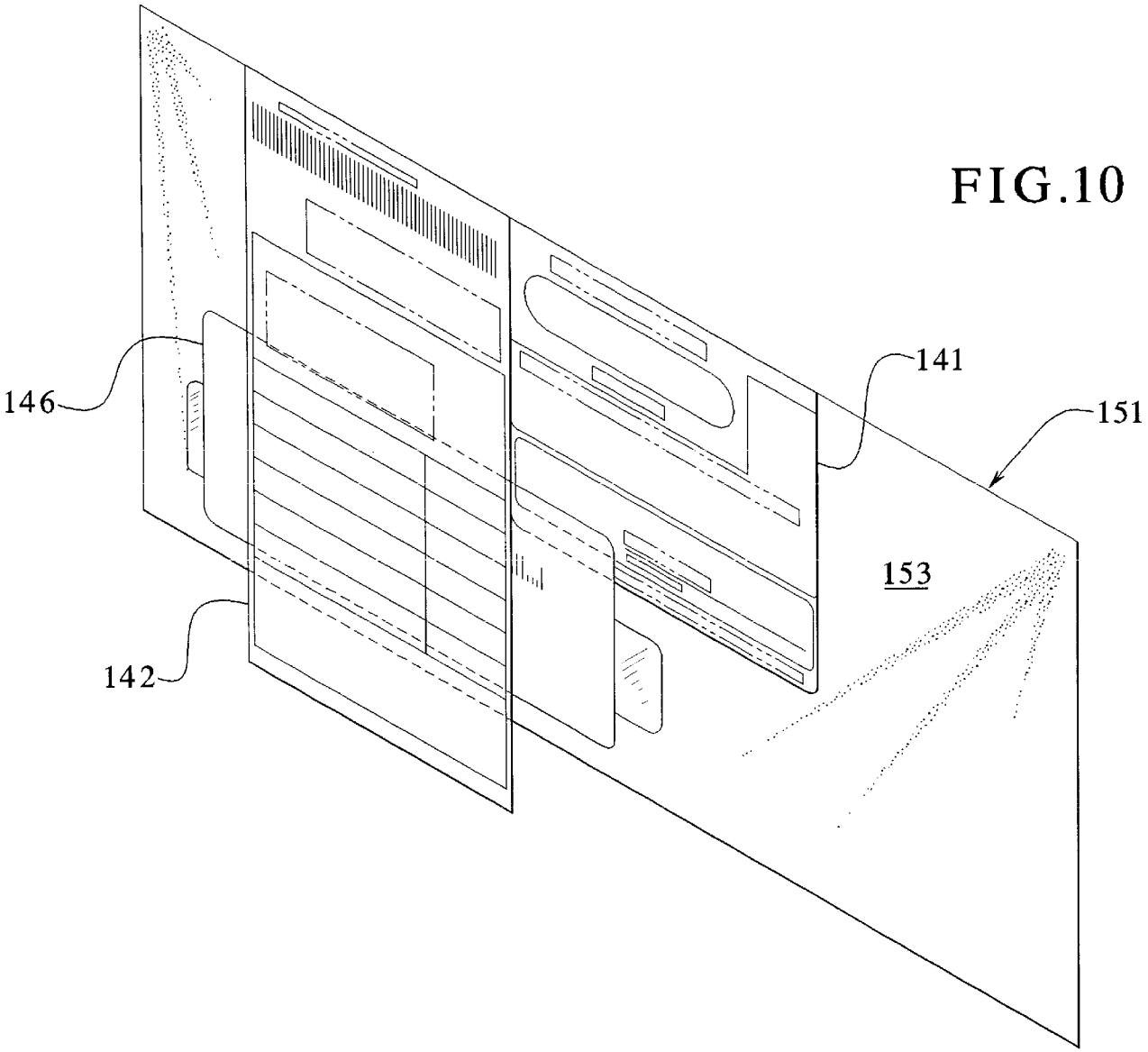
FIG. 10 illustrates a perspective view of an embodiment of a front or address side of a mailpiece or shipping item with attachment of a portion of the label/form required for special service mail or shipment handling of the mailpiece or shipping item.
Figure 11:
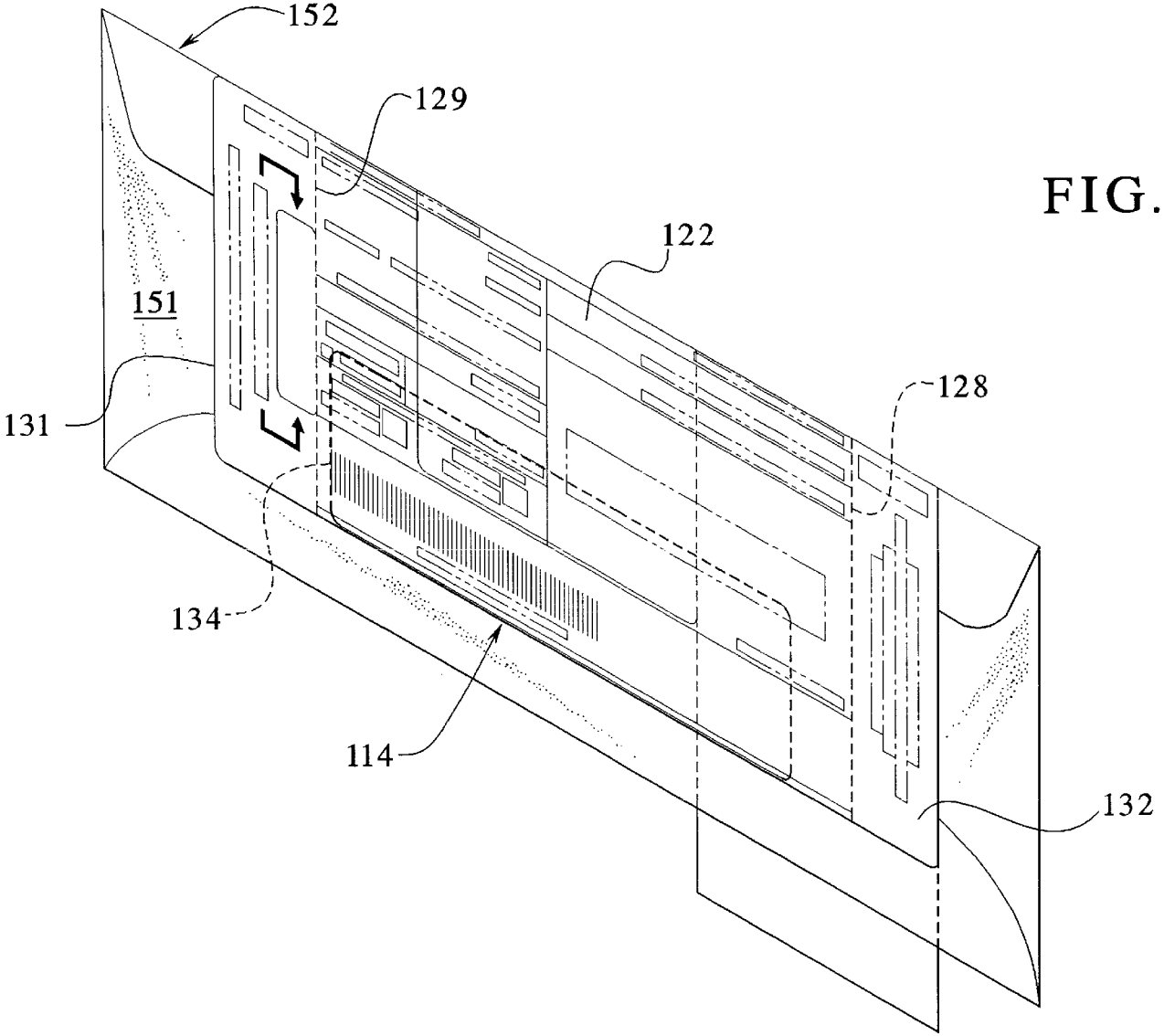
FIG. 11 illustrates a plan view of an embodiment of a back side of a mailpiece or shipping item with a second portion of the label/form required for special service handling of the mailpiece or shipping item.

Still referring to FIG. 11, the return postcard section 114 and the adhesive sections 131,132 are then attached to a back side 151 of the article to be mailed 152 which, as illustrated in FIGS. 10 and 11, may be an envelope. Then, as illustrated in FIG. 10, the receipt label 142 and the service identification label 141 are then folded over and onto the front side 153 of the envelope 151. After the receipt 142 has been filled out and postmarked, it can be easily removed by pulling it off of the envelope 151 and tearing it along the score line shown at 154 in FIGS. 8 and 9.

After the envelope 152 has been shipped to the addressee, and the addressee or a representative has acknowledged receipt by signing in the signature space 122, the postcard 114 can be removed from the envelope 152 by tearing along the perforated lines 128,129. With the sender return address label 134 in place on the back side 133 of the postcard 114 as illustrated in FIGS. 9 and 11, the postcard 114 is then ready to be mailed. It will be noted hat the back side 133 of the postcard 114 should be preprinted with a first-class mail permit number and a return address listing the United States Postal Service as the return addressee.

Figure 12:
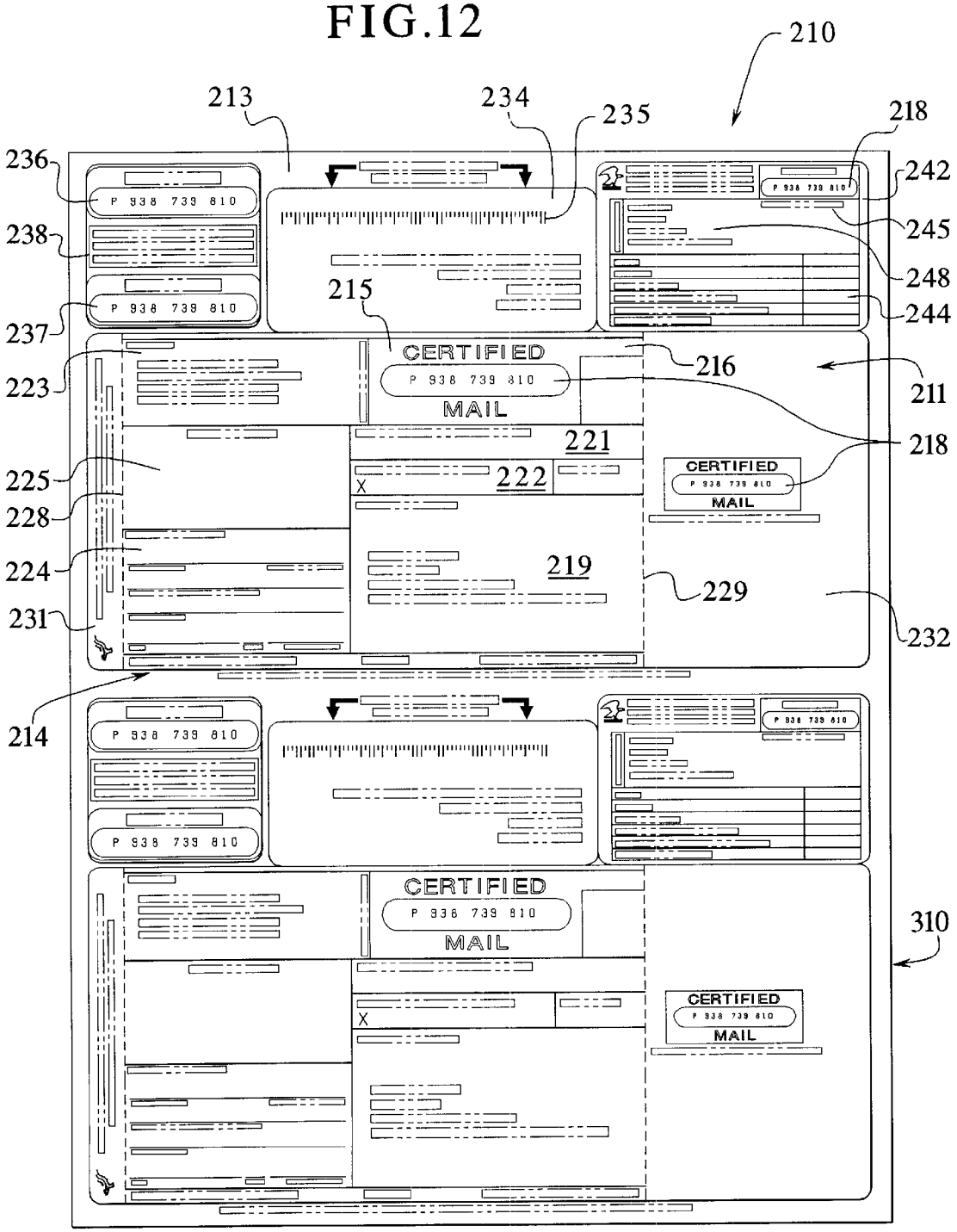
FIG. 12 illustrates a plan view of an embodiment of a front side of two label/forms of the present invention affixed to a single backing sheet.
Figure 13:
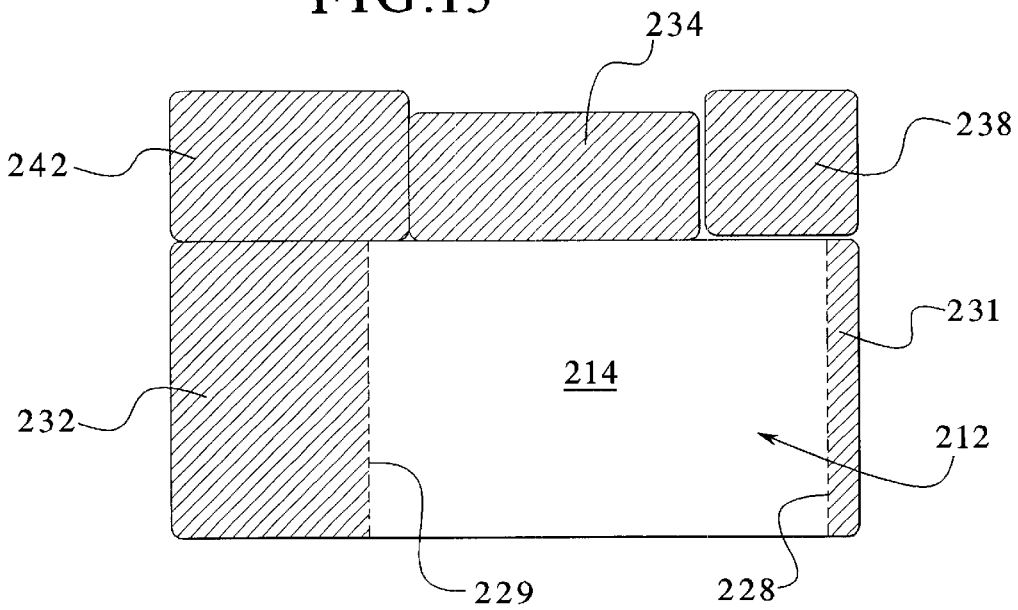
FIG. 13 illustrates a plan view of an embodiment of a back side of a label/form for special service mailing/shipping of a mailpiece or shipping item.

In a further alternative embodiment illustrated in FIGS. 12–17*b*, a label/form 210 consists of a plurality of detachable parts. The parts of the label/form 210 are detachable by tear lines, score lines, perforations or the like. FIG. 12 illustrates a first or a front side 211 of the label/form 210 while FIG. 13 illustrates a second or back side 212 of the label/form 210. It should be noted that the label/form 210 illustrated in FIG. 12 is for certified mail. However, any type of special service mailing or shipping may be satisfied with the present invention, including, but not limited to, registered mail, insured mail, recorded delivery, return receipt for merchandise, C.O.D. etc.

The label/form 210 illustrated in FIGS. 12 and 13 has a backing sheet 213 ad a plurality of detachable parts attached to the backing sheet 213 that are defined by tear lines, score lines, or perforations that extend through the sheet 213 or through the front side 211 to the back side 212. The label/form 210 is sized to occupy only one-half of the space on one side of the backing sheet 213. Accordingly, a second label/form 310 may also be attached to the backing sheet 213. Label/form 310 is identical in both appearance and function to label/form 210 and the following detailed description is applicable to both label/form 210 and label/form 310.

As illustrated in FIG. 12, a return postcard is generally shown at 214. The postcard 214 includes an article identification section 216 which may include an article number 218 or other suitable means for uniquely identifying the article being shipped. An addressee identification section 219 is provided on which the name and address of the addressee is pre-printed. A receiver identification section 221 and a receiver signature section 222 are also provided to record the name and signature of the person acknowledging receipt of the article.

Additional informational sections are also provided on the return postcard 214 since this return postcard 214 also serves as the primary addressee address label for delivery of the article. Accordingly, the return postcard 214 also includes a sender identification section 223 and an addressee address correction section 224. If so desired, an additional article identification section 225 may also be provided.

The return postcard 214 includes two perforated tear lines 228,229 which separate the postcard 214 from the two adhesively-backed anchor sections 231,232. Of course, the perforated tear lines 228,229 may be suitably replaced with score lines or the like which are generally well known to those having ordinary skill in the art. The two anchor sections 231,232 enable the postcard 214 to be removably attached to the article to be mailed because, as illustrated in FIG. 13, the entire back side 212 of the label/form 210 is coated with an adhesive with the exception of the back side of the postcard 214. Thus, the two anchor sections 231,232 may be affixed to the article to be mailed and the postcard 214 may be detached from the anchor sections 231,232 and the article to be mailed by tearing along the two perforated tear lines 228,229.

Also illustrated in FIG. 12 is the return address label 234 that may be pre-printed with the sender's address. After the label/form 210 is removed from its associated backing sheet 213, the label 234 is then folded over and onto the back side 212 of the label/form 210 (specifically, the back side of the postcard 214).

In another embodiment, return address label 234 is folded over and onto the back side of the mailpiece to which the label/form 210 is attached. In yet another embodiment, the return address label 234 is detachable from the label/form 210 and is separately attached to the desired mailpiece. By providing the return address label 234 on the front side 211 of the label/form 210, the label 234 may be simultaneously pre-printed with the other components of the label/form 210 shown in FIG. 12 thereby eliminating any need for pre-printing any components shown on the back side 212 in FIG. 13. Accordingly, all of the information specific to the article being mailed is printed on the front side 211 of the label/form 210 which eliminates the need for any two-sided printing.

As illustrated in FIG. 12, the return address label 234 may also include a bar code 235 or other identification means associated with the article to be mailed. Additional article identification labels 236,237 in article identification section 238 may also be provided.

A receipt label 242 may also be provided on the label/form 210. The receipt label 242 preferably includes the article identification number 218 or other suitable identification means. The receipt label 242 may also include an addressee identification section 248, a fee calculation section 244 and a space 245 for indicating the postmark or postage date.

Figure 14:
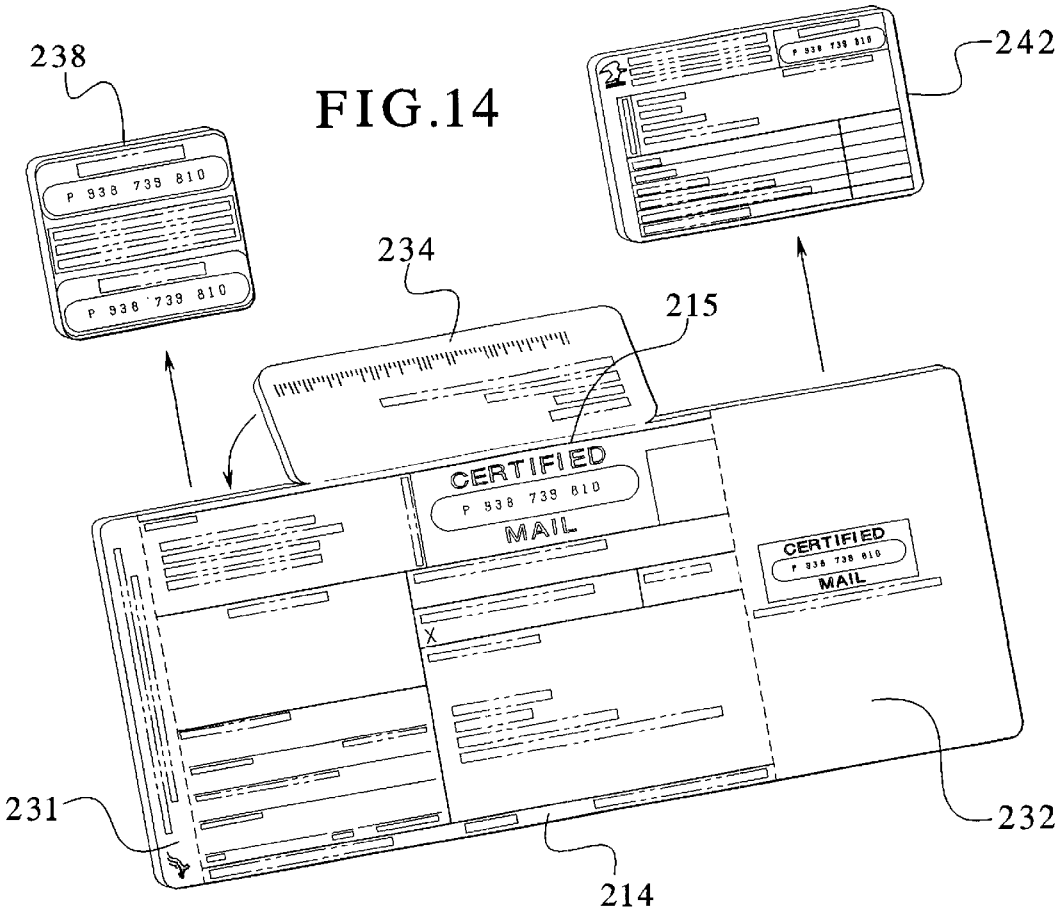
FIG. 14 illustrates a perspective view of an embodiment of a front side of the label/form required for special service mailing or shipping of the mailpiece or shipping item with label sections removed and with a return address section being folded back upon a back side of the label/form.

In a preferred embodiment, the return postcard, the return postcard 214, the anchor sections 231,232, the return address label 234, the article identification section 238 and the receipt label 242 may all be detachably connected together as illustrated in FIG. 12. In use, and as shown in FIG. 14, the article identification section 238 is removed from the backing sheet 213 and the remainder of the label form 210 wherein the article identification section 238 may be used by the sender of the article for various article identification record-keeping purposes. Then, the receipt label 242 may be detached from the remainder of the label/form 210, along with its associated portion of the backing sheet 213, wherein the receipt label 242 may be retained by the sender of the article as a mailing receipt. Next, the combination of the return postcard 214, anchor sections 231,232 and the return address label 234 are detached from the backing sheet 213. The return address label 234 may then be folded back along fold line 215 and affixed onto the back side of the postcard 214 as illustrated in FIG. 14, folded back along fold line 214 and affixed onto the back side of the relevant mailpiece, or detached from the remainder of the label/form 210 and separately attached to the mailpiece.

Figure 15:
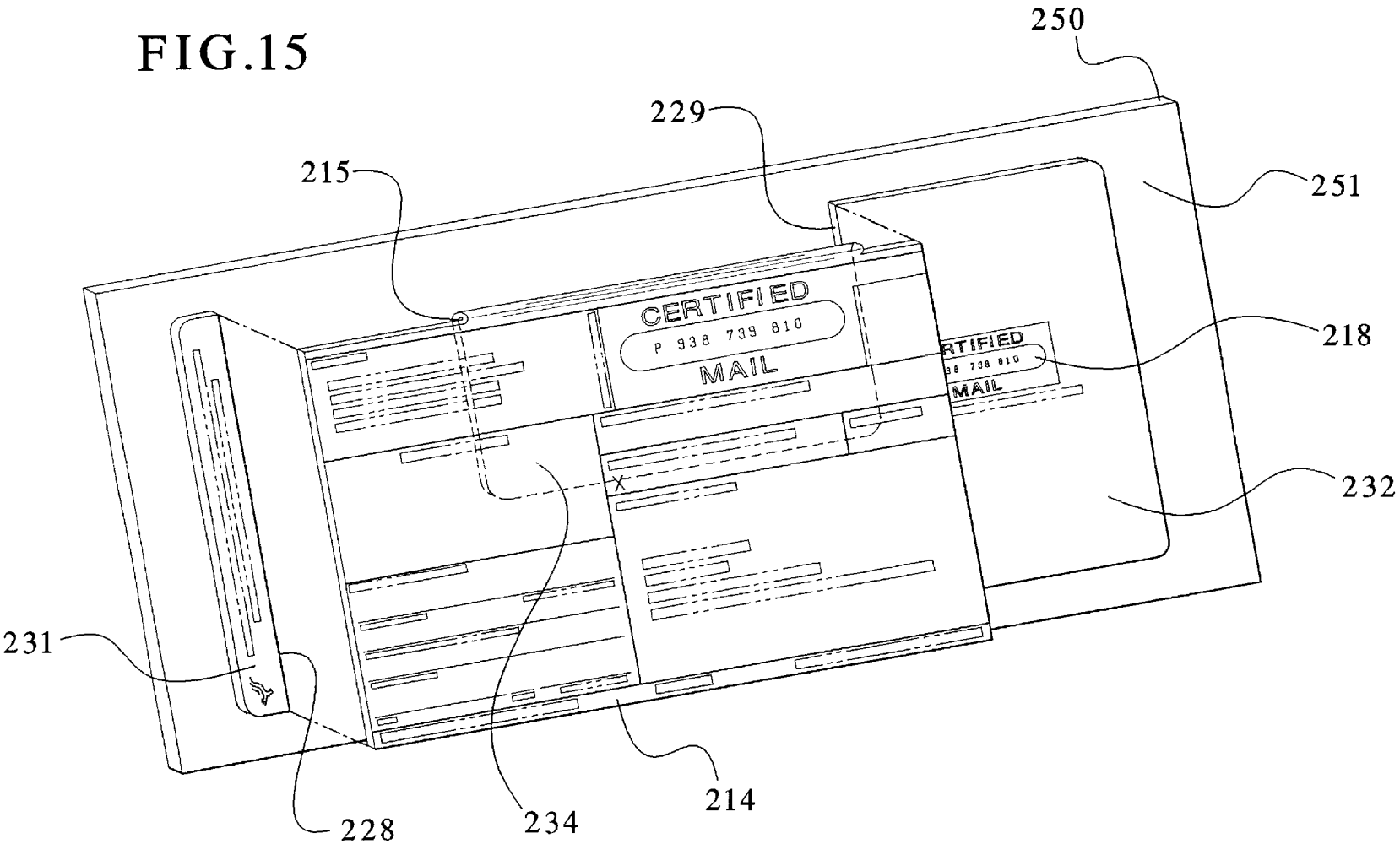
FIG. 15 illustrates a perspective view of an embodiment of a front or address side of a mailpiece or shipping item with attachment of a portion of the label/form required for special service mailing of the mailpiece, a return address section being folded back upon a back side of the label/form and a detachable card section shown detached from the remainder of the label/form.

Referring to FIG. 15, the return postcard 214 and the anchor sections 231,232 are attached to a single side 251 of the article 250 to be mailed. After the article 250 is delivered to the addressee, and the addressee or representative has acknowledged receipt by signing in the signature space 222, the return postcard 214 may be detached from the article 250 by tearing along the perforated tear lines 228,229. With the return address label 234 (hidden from view, shown by dashed lines) in place on the back side of the return postcard 214, the return postcard 214 is ready to be mailed. Of course, the back side of the return postcard 214 may be preprinted with a first-class mail permit number and a return address listing the United States Postal Service as the return addressee.

Figure 16:
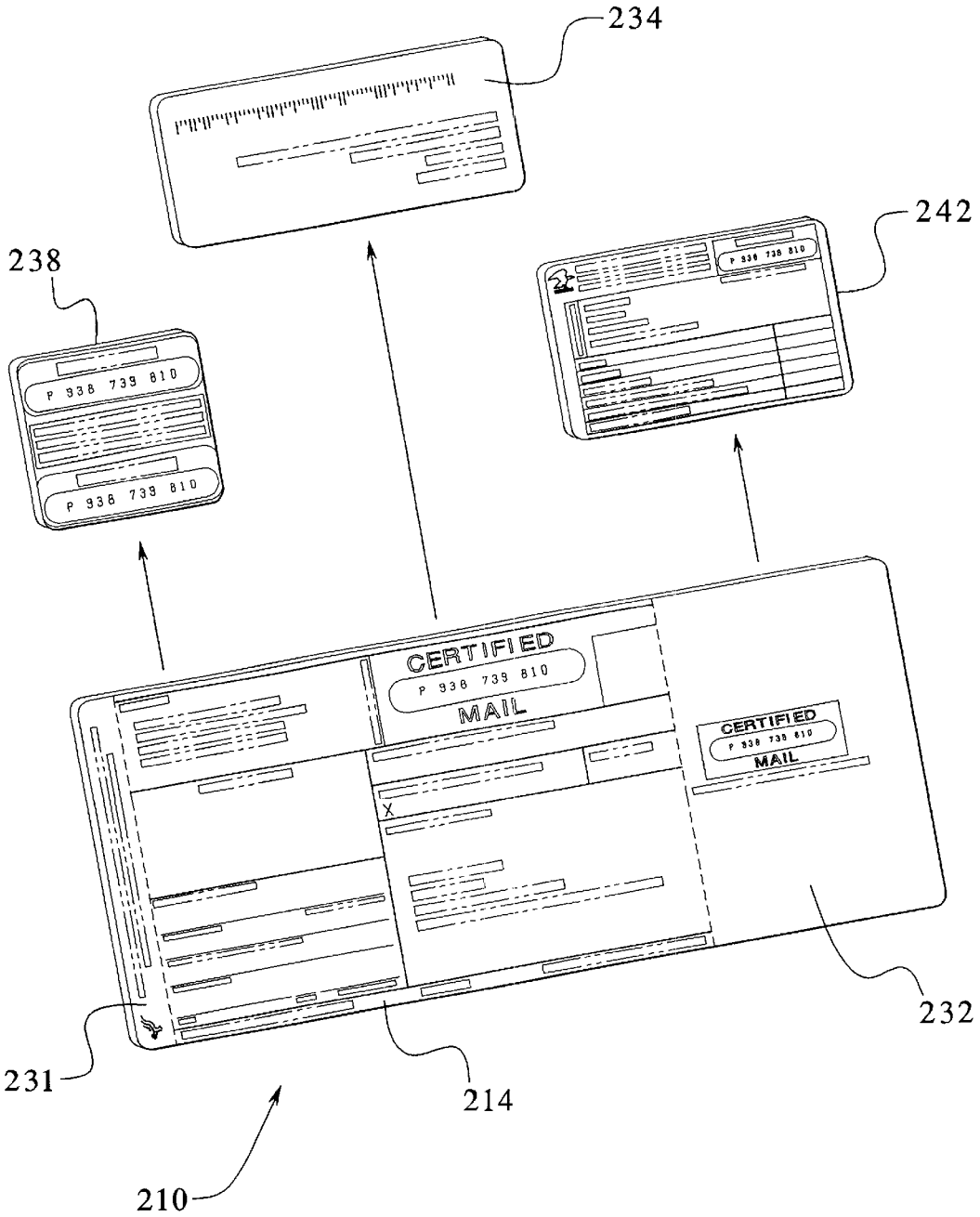
FIG. 16 illustrates a perspective view of an embodiment of a front side of the label/form with both the return address section and the label sections removed.

FIG. 16 shows an alternative embodiment of the label/form 210 of the present invention wherein the return address label 234 may be altogether detached from the remainder of the label/form 210 along with the article identification section 238 and the receipt label 242. With such an embodiment, the return address label 234 may be affixed anywhere on the mailing article as a return address label separate and apart from the remainder of the label/form 210.

Figure 17A:
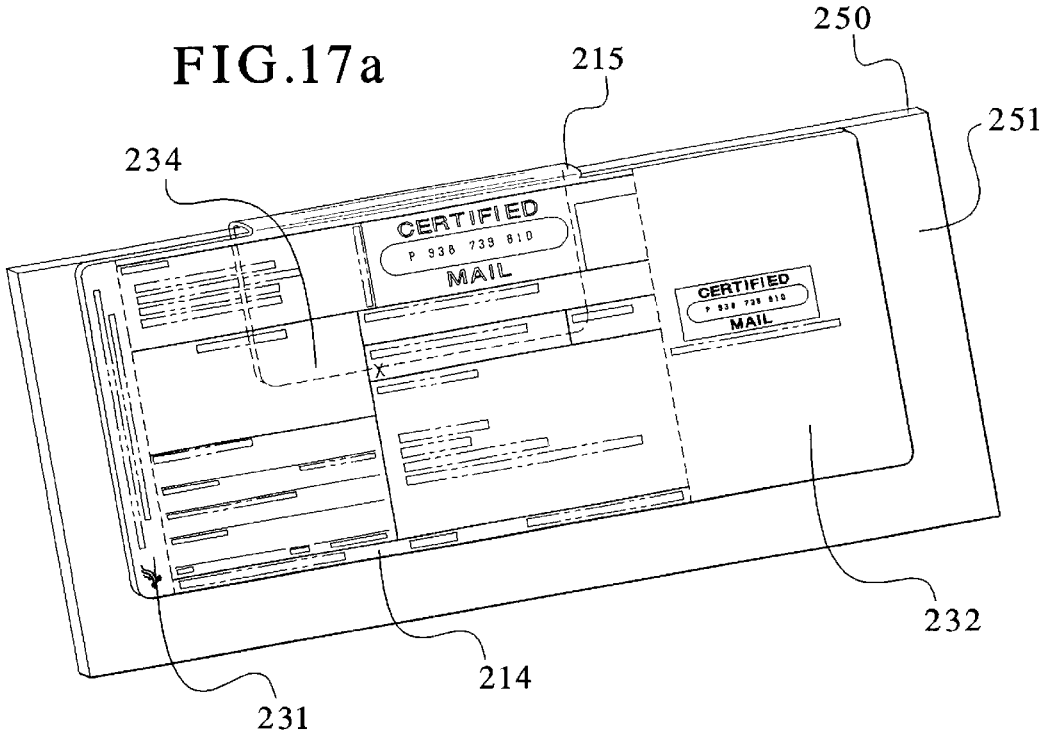
FIG. 17*a* illustrates a perspective view of an embodiment of a front or address side of a mailpiece or shipping item with attachment of a portion of the label/form required for special service mailing of the mailpiece, a return address section folded back upon a back side of the mailpiece.

In another embodiment of the present invention, as shown in FIG. 17*a*, the return address label 234 remains affixed to the remainder of the label/form 210 but is folded over, and affixed to, the back side of the article 250. More specifically, after the first and second anchor sections 231,232 and return postcard 214 are attached to the front side 251 of the article 250, the return address label 233 is folded along fold line 215 so as to lay against the back side of the article 250.

Figure 17B:
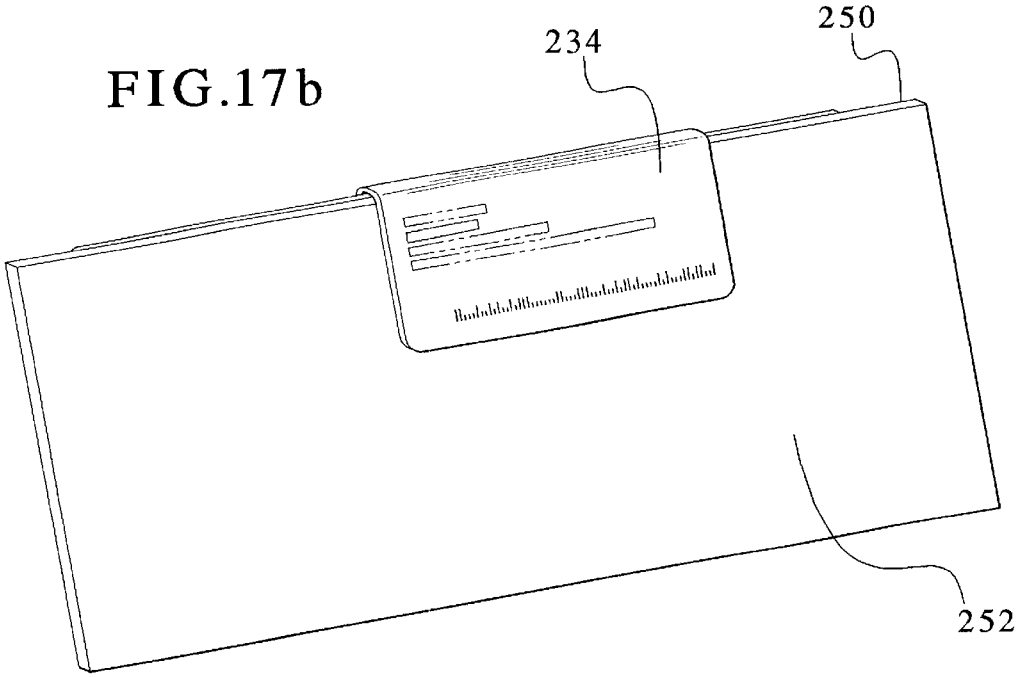
FIG. 17*b* illustrates a perspective view of an embodiment of the back side of the mailpiece from FIG. 17*a* showing the return address section folded back upon the back side of the mailpiece.

FIG. 17*b* illustrates a rear view of the article 250 after the return address label 234 has been folded over and affixed thereto. The positioning of the return address label 234 in this manner on the back side 252 of the article 250 allows it to serve as a standard return address label for mailing purposes.

Of course, the particular arrangement of the present invention is suitable for many types of mailpiece or shipping items requiring special service and for a variety of mailpiece or shipping items requiring special service mailing. Furthermore, printing of the label/form may be conducted in any known manner, such as by hand, by feeding the sheet through a printer, or by a continuously fed printer being either an impact or non-impact type. The present invention is not to be limited in the manner in which the label/form itself is printed as the same may be implemented by those skilled in the art.

Figure 18:
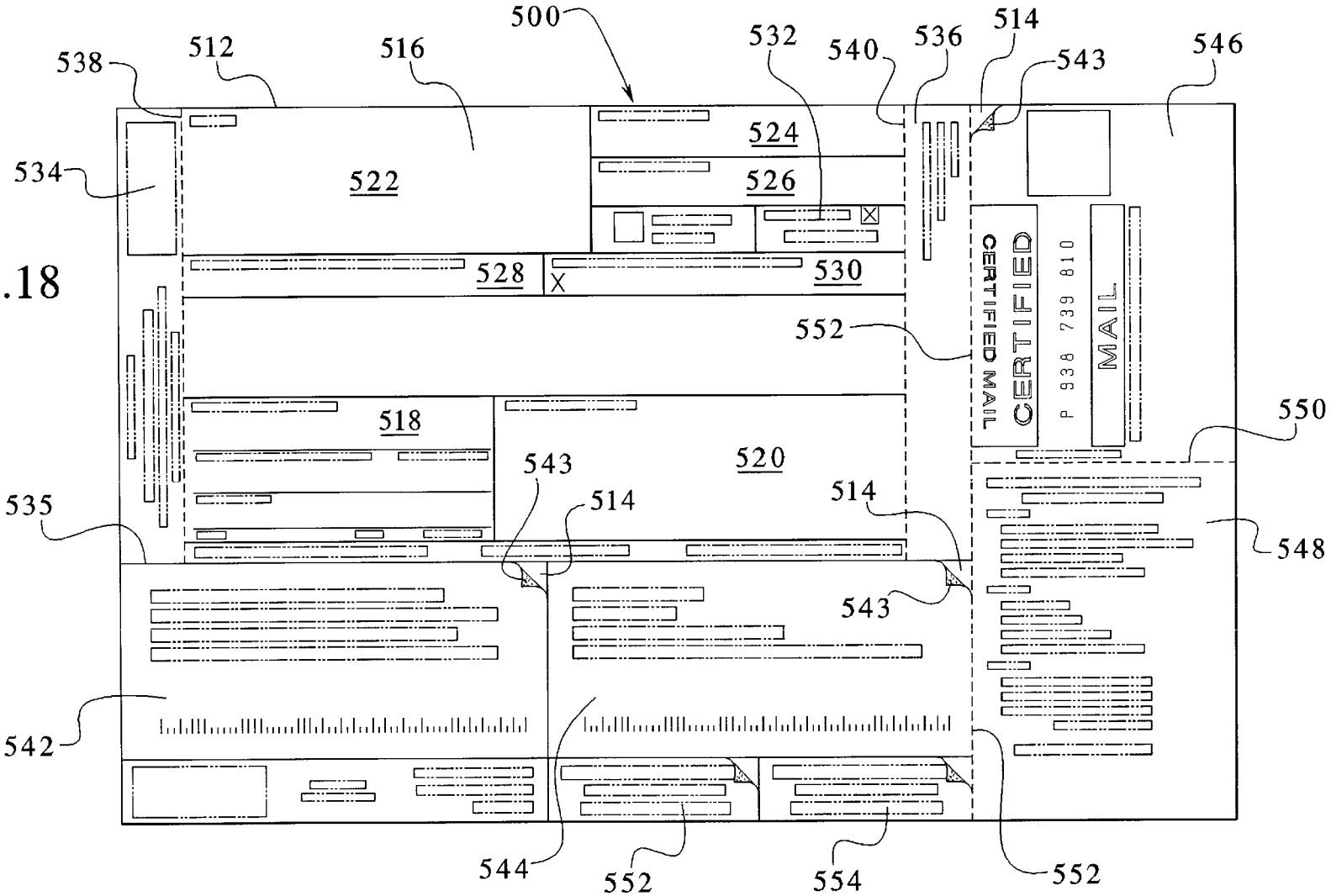
FIG. 18 illustrates a plan view of an embodiment of a front side of a label/form for special service mailing/shipping of a mailpiece or shipping item.
Figure 19:
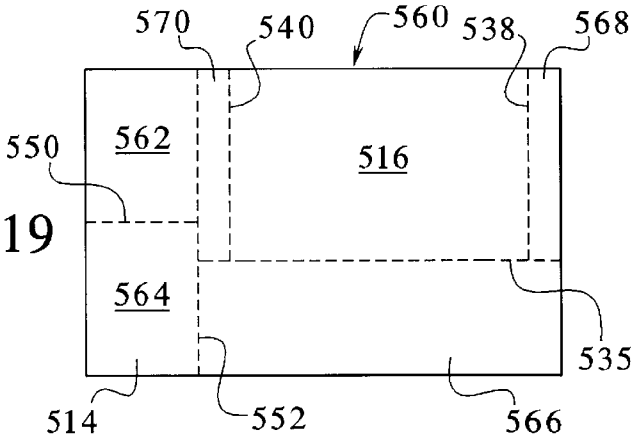
FIG. 19 illustrates a plan view of an embodiment of a back side of a label/form for special service mailing/shipping of a mailpiece or shipping item.

The label/form 500 illustrated in FIG. 18 includes a front layer 512 and a backing layer 514. The label/form 500 may include a plurality of detachable parts that may be defined by tear lines, score lines, or perforations that may extend through the front layer 512, or through the front layer 512 and the backing layer 514, as illustrated in FIGS. 18 and 19. Generally, the front layer 512 may include a return postcard 516 and may generally be the same as is illustrated in FIGS. 8 and 12. The return postcard 516 may include a plurality of sections for information to be added by hand or by a printer device. The return postcard 516 may include an addressee address section 518, an article addressed to section 520, a sender address section 522, a date of delivery section 524, an article number section 526, a "received by" section 528, a signature section 530 and a "service type" section 532. The present invention is not meant to be restricted by the information carried on the return receipt postcard.

On opposite ends of the return postcard 516 may be two anchor portions 534 and 536. The return postcard 516 may be separable from the anchor portions 534 and 536 via tear lines 538 and 540, respectively. The return postcard 516 and the anchor portions 534,536 may be detachable from a remainder of the label/form 500 via tear lines 535 and 537.

A return address section 542 for the return postcard 516 may be provided disposed adjacent to the return postcard 516. The return address section 542 may be a peel-and-stick type label. The return address section 542 may contain an adhesive on a backside of the return address section 542 and may be removably attached to the backing layer 514. In use, the return address section 542 may peel off the backing layer 514 and may be placed on the backside of the return postcard 516.

An addressee label section 544 may also be provided adjacent to the return postcard 516 although the positions of the detachable label sections are not meant to limit the invention in any way. The addressee label section 544 may also be a peel-and-stick type label which may contain an adhesive 543 on an underside of the addressee label section 544. The addressee label section 544 may be removed from the label/form 510 and placed on the article to be mailed.

A special services designator section 546 may be provided adjacent the return postcard 516. The special services designator section 546 may be a peel-and-stick type label that may contain the adhesive 543. The designator section 546 may peel off the backing layer 514 and may be placed on the article to be mailed by a special service. A receipt section 548 may be disposed adjacent the designator section 546 and may be separable from the designator section 546 via a tear line 550. The tear line 550 may extend through both the front layer 512 and the backing layer 514. Both the designator section 546 and the receipt section 548 may be separable from the remainder of the label/form 500 via a tear line 552. The tear line 552 may extend through both the front layer 512 and the backing layer 514.

In use, the label/form 500 may be printed upon by hand or by a printer. The printer may be any commonly known in the art, including, but not limited to, impact-type printers, ink jet printers, thermal printers and the like.

The designator section 546 and the receipt section 548 may be removed together from a remainder of the label/form 500 via the tear line 552. A backing layer section 564 of the backing layer 514 (as shown in FIG. 19) may then be removed from only the designator section 546 whereupon both the designator section 546 and the receipt section 548 may be placed on the article to be mailed in a location identifying the article to be delivered by a special service.

The receipt section 548 may remain attached to the designator section 546 until the receipt section 548 is, for example, date-stamped by the U.S. Postal Service whereupon the receipt section 548 may be detached from the designator section 546 via the tear line 550 and may be retained by the sender of the article. The return postcard 516 may then be removed from a remainder of the label form 500. The return address section 542 may be removed from the backing layer 514 and may be placed upon the backside of the return postcard 516 to aid in the delivery of the return postcard 516 to the sender after delivery of the article by the special service. The addressee section 544 may be removed from the label/form 500 and placed upon the article to aid in the delivery of the article by the special service.

The label/form 500 may also include a plurality of extra label sections 552,554 containing the article number to be retained by the sender for the sender's records. The extra sections 552,554 may also be peel-and-stick type label sections that may peel from the backing layer 514.

Of course, the particular arrangement of the present invention is suitable for many types of mailpieces or shipping items requiring delivery by a special service. The present invention is not to be construed as to the manner in which the label/form 500 is arranged or printed. Nonetheless, the unique arrangement of the components of the label/form 500 provides a simplified manner to print and use the label/form 500.

FIG. 19 illustrates a plan view of a backside 560 of the label/form 500. Generally, the backside 560 of the label/form 500 may include a backing layer 514 disposed over the entire backside 560 of the label/form 500. The designator section 546 may include a backing layer section 562 which is a part of the backing layer 514. Disposed adjacent the backside of the designator section 562 may be the backing layer section 564 for the receipt section 548. Both of the backing layer sections 562,564 may be separable from a remainder of the backing layer 514 via the tear line 552. The backing layer section 562 may be separable from the backing layer section 564 via the tear line 550.

As shown in FIG. 19, the tear lines 535, 538 and 540 may extend through the backing layer 514. Anchor portion backing layers 568, 570 may be part of the backing layer 514.

Figure 20:
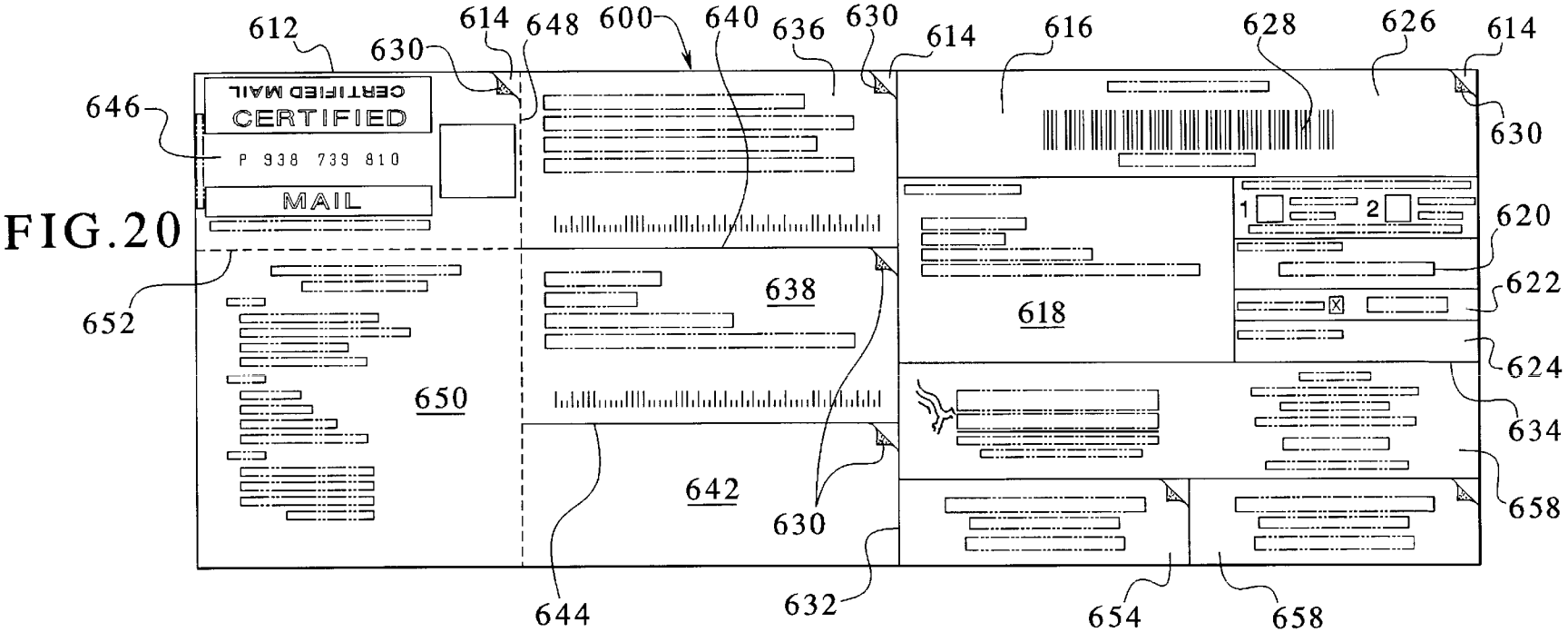
FIG. 20 illustrates a plan view of an embodiment of a front side of a label/form to be utilized with a return postcard for special service mailing/shipping of a mailpiece or shipping item.

FIG. 20 illustrates a label/form 600 which may contain a front layer 612 and a backing layer 614. A return receipt information section 616 may be provided on the label form 610. The return receipt information section 616 may contain the same information as required on a special services return postcard, such as, for example, the return postcard 516 as shown in FIG. 18. The return receipt information section 616 may contain the following sections, although other sections are contemplated as may be required for delivery by a particular special service: an addressee section 618, an article section 620, a service type section 622, a date of delivery section 624 and a machine readable bar code section 626. A machine readable bar code 628 may be printed or pre-printed within the machine readable bar code section 626. The return receipt information section 616 may be removably attached to the backing layer 614 via an adhesive 630 disposed on a backside of the return receipt information section 616. The return receipt information section 616 may be detachable from a remainder of the label/form 600 via tear lines 632,634.

In use, the return receipt information section 616 may be peeled or removed from the backing layer 614 and placed on a return postcard (not shown) corresponding to U.S. Postal Service form 3811. The return receipt information section 616 may correspond with information sections on the return postcard.

A return address section 636 may be provided on the label/form 600. The return address section 636 may contain information corresponding to where the return postcard should be delivered following delivery of the article by the special service. The return address section 636 may be removable from a remainder of the label/form 600 via tear lines 640, 632 and 648. The tear line 648 may extend through both the front layer 612 and the backing layer 614. The return address section 636 may be a peel-and-stick type label removably attached to the backing layer 614 via the adhesive 630. In use, the return address section 636 may be peeled or removed from the backing layer 614 and placed on a backside of the return postcard (not shown) to aid in the delivery of the return postcard.

Figure 21:
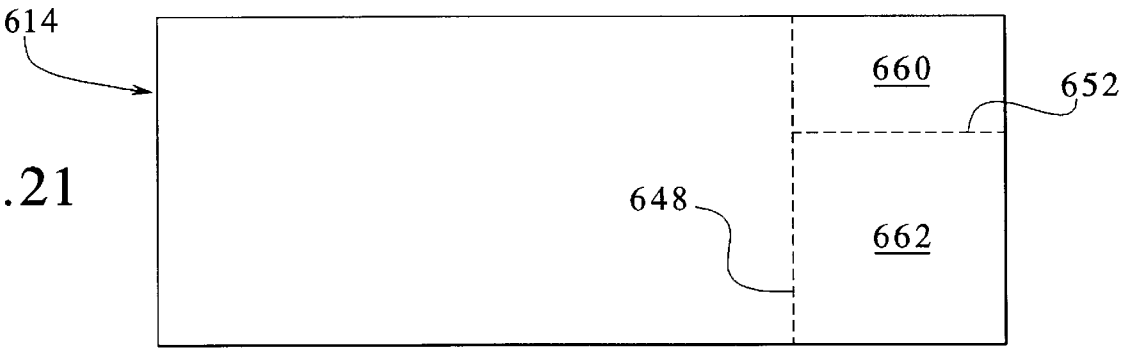
FIG. 21 illustrates a plan view of an embodiment of a back side of a label/form to be used with a return receipt postcard for special service mailing/shipping of a mailpiece or shipping item.

An addressee address section 638 may be provided on the label/form 600 via tear lines 640, 648 and 644 and may be peelable from the backside layer 614 via tear lines 640, 632, 648 and 644. The tear lines 640, 632 and 644 may extend through the front layer 612 of the label/form 600 and not through the backing layer 614. The tear line 648 may extend through both the front layer 612 and the backing layer 614, as shown in FIG. 21. In use, the addressee address section 638 may be peeled or removed from the backing layer 614 and placed upon the article to aid in the delivery of the article by the special service.

An optional label section 642 may be provided on the label/form 600. The optional label section 642 may be peelable from the backing layer 614 via the tear lines 644, 632 and 648. The tear lines 644 and 632 may extend through only the front layer 612 of the label/form 600. The optional label section 642 may be used by the sender of the article to aid in the delivery of the article by the special service. For example, the optional label 642 may contain an electronic postage designation, such as an E-stamp, or other like designation. It should be noted that the label sections 636, 638 and 642 are not to be limited in the manner herein described. The label sections 636,638 and 642 may be utilized in any way apparent to those skilled in the art.

A special services designator section 646 may be provided on the label/form 600 and may be detachable from a remainder of the label/form 600 via tear lines 648 and 652. Both of the tear lines 648,652 may extend through both the front layer 612 and the backing layer 614. A receipt section 650 may be provided adjacent the special services designator section 646 and may be detachable from the designator section 646 via the tear line 652. The designator section 646 may be a peel-and-stick type label removably attached to the backside 614 via the adhesive 630.

FIG. 21 shows a backing layer 614 including a backing layer section 660 provided on a backside of the designator section 646 and a backing layer section 662 provided on a backside of the receipt section 650. The backing layer sections 660 and 662 may be detachable from one another via the tear line 652 and may be removable from a remainder 664 of the backing layer 614 via the tear line 648.

In use, the designator section 646 and the receipt section 650 may be removed from a remainder of the label/form 600 via the tear line 648. The backing layer 614 is removed exposing only the adhesive 630 on the designator section 646. The designator section 646 may then be placed on the article to be mailed. The receipt section 650 may be removed from the designator section 646 after, for example, the Post Office has date-stamped the receipt section 650. The receipt section 650 may then be retained by the sender as a receipt.

Auxiliary labels 654,656 may be provided and may contain the mailpiece number to be retained by the sender to aid the sender in tracking the article during delivery. A supplemental section 658 may be provided and may contain information to aid in the delivery of the article by the special service or may contain other information such as, for example a company logo or company address.

Figure 22:
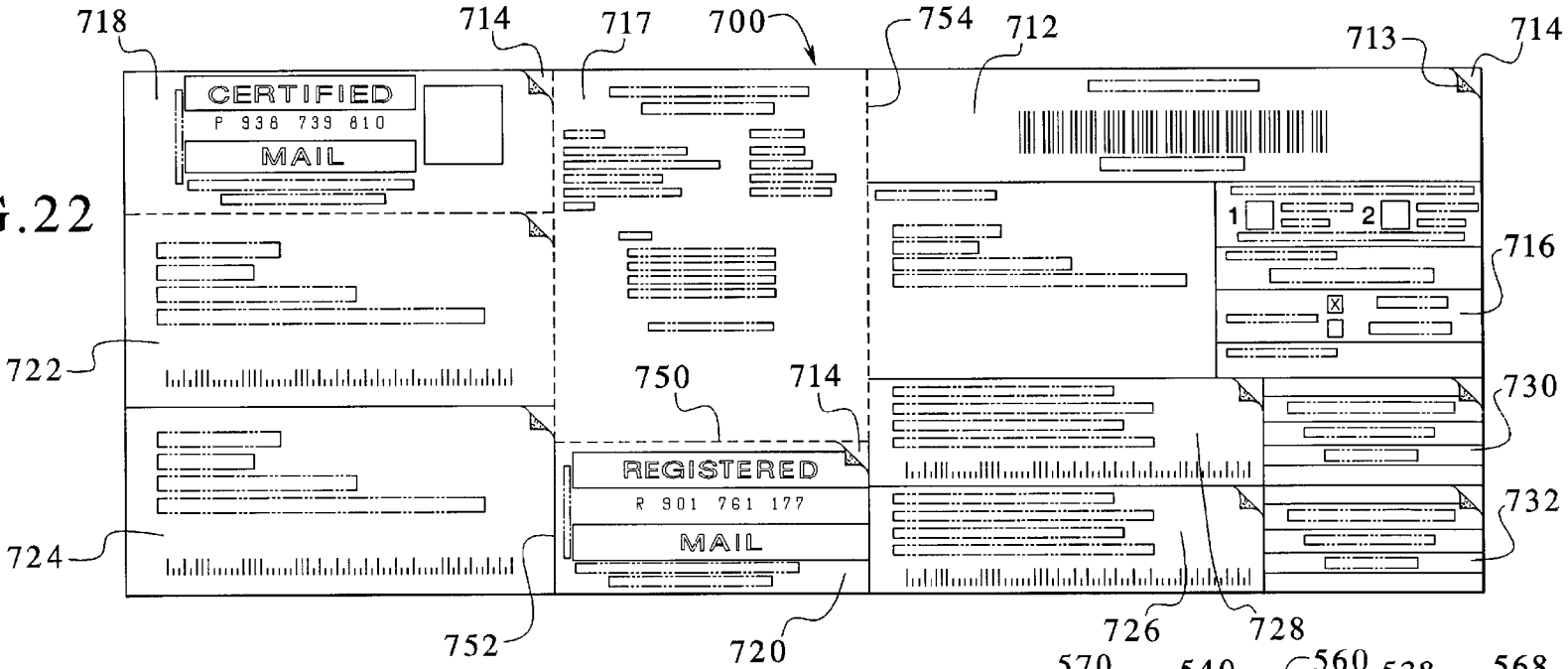
FIG. 22 illustrates a plan view of an embodiment of a front side of a label/form having alternative special service designators for special service mailing/shipping of a mailpiece or shipping item.

FIG. 22 illustrates a label/form 700 having a plurality of detachable parts including a return receipt information section 712 containing a plurality of sections. The return receipt information section 712 may be a peel-and-stick type label containing an adhesive 713 on a backside of the return receipt section 712. The return receipt section 712 may be removably attached to a backing sheet 714. The return receipt information section 712 may contain information required on a special service return postcard. In particular, the return receipt information section 712 may contain a service-type designation section 716 in which a sender may specify whether the article is to be delivered by one of two or more special services, such as, for example, certified mail or registered mail. This embodiment does not limit the special services to certified mail or registered mail. Any special service may be utilized and provided for on the return receipt information section 712. In use, the return receipt information section 712 may be peeled or removed from the backside layer 714 and attached to a return postcard (not shown).

Attached to the label/form 700 may be a first special services designation section 718 corresponding to one particular service, such as, for example, certified mail. Further, also removably attached to the label/form 700 may be a second special services designation section 720 corresponding to another particular special service, such as, for example, registered mail. Removably attached to both the first special services designation section 718 and the second special services designation 720 may be a receipt section 717. The first special services designation section 718 may be removably attached to the receipt section 717 via the tear line 752. Further, the second special services designation section 720 may be removably attached to the receipt section 717 via the tear line 750. Both the receipt section 717 and the first special services designation section 718 may be removable from a remainder of the label/form 700 to be applied to a mailpiece for non-domestic delivery thereof.

If the sender of the mailpiece wishes to send the mailpiece by a first special service, such as, for example, certified mail, the sender may remove the first special services designator section 718 and the receipt section 717 and may keep the first special services designator 718 and the receipt section 717 attached together via the tear line 752. The first special service may correspond to the first special services designator section 718. Further, if the sender wishes to send the mailpiece by a second special services, such as, for example, registered mail, the sender may peel or remove the second special services designator section 720 from the label/form 700 and apply it over the first special services designator section 718.

The first special services designator section 718, the second special service designator section 720 and the receipt 717 may then be applied to a mailpiece by peeling or removing the first special services designator section 718 from the backing layer section 742 with or without the second special services designator section 720. The backing layer section 746 may remain attached to the receipt section 717. The first special service designator section 718 may then be applied to a mailpiece, such as, for example, in a conspicuous location so as to be readily identified as requiring delivery by a special service. The U.S. Postal Service may then date-stamp the receipt section 717 whereupon the sender may remove the receipt section 717 and retain it for his or her records.

The label/form 700 may include a plurality of auxiliary labels 722, 724, 726 and 728. The auxiliary labels 722, 724, 726 and 728 may be utilized in any manner apparent to those skilled in the art.

Auxiliary designator sections 730,732 may be provided. The auxiliary designator section 730 may correspond to a first special service, such as, for example, certified mail. Auxiliary designator section 732 may correspond to a second special service, such as, for example, registered mail. These auxiliary designator sections 730,732 may be peel-and-stick type labels containing an adhesive 713 and removably attached to the backing layer 714. These auxiliary label sections 730,732 may be used by the sender in any manner apparent to those skilled in the art to aid in the delivery of the article by a special service.

The label/form 700 may be provided as a "blank" form whereupon the sender chooses whether to send the article by one of two special services. For example, the special service may be certified mail or registered mail. The information relating to the delivery of the article by the special service chosen may then be printed on the label/form 700 by hand or any type of printing device apparent to those skilled in the art.

Further, two or more label/forms 700 may be provided removably attached to one another. The attachment of multiple label/forms 700 together may allow the assembly to measure 8½"×11" to aid in the storage and/or printing of the label/form 700 by, for example, a printing device.

Figure 23:
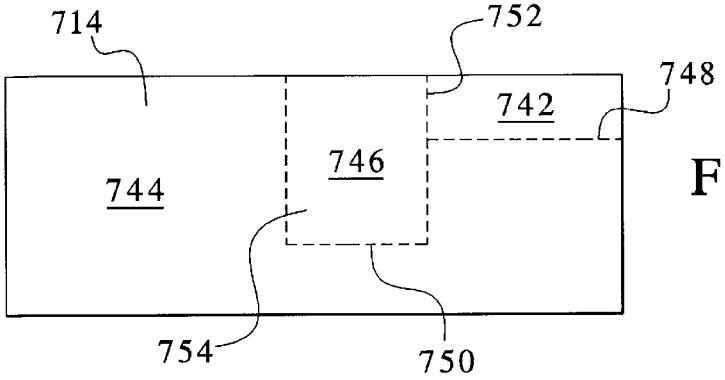
FIG. 23 illustrates a plan view of an embodiment of a back side of a label/form having alternative special service designators required for special service mailing/shipping of a mailpiece or shipping item.

FIG. 23 shows the backing layer 714 of the label/form 700 indicating the various tear lines that extend through both of the label/form 700 and the backing layer 714. The backing layer section 742 may be attached to the backside of the first special services designator section 718. The backing layer section 746 may be attached to the backside of the receipt section 717. The backing layer section 742 may be separable from a remainder of the backing layer section 714 via the tear line 748. The backing layer section 744 may further be detachable from the backing layer section 746 via the tear lines 750, 752 and 754. The backing layer section 746 may be removable from the certified mail designator section 718 via the tear line 752.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. An assembly for shipping and handling an article requiring delivery by a special service, the assembly comprising:

a first sheet having a first label wherein the first label has information related to the delivery of the article by the special service wherein the first label attaches to a return postcard;

a first special services designation section including information indicative of a first special service and a second special services designation section including information indicative of a second special service attached to the first sheet wherein the first special service is distinct from the second special service, a return receipt information section removably attached to the first special services designation section and the second special services designation section wherein the return receipt information section attaches to the return postcard;

an auxiliary label on the assembly; and a backing layer disposed on a backside of the first layer.

2. The assembly of claim 1 further comprising:

an adhesive layer disposed between the first layer and the backing layer.

3. The assembly of claim 1 wherein the first label has information that corresponds to U.S. Postal Service Form 3811.

4. The assembly of claim 1 wherein the auxiliary label corresponds to a receipt for the delivery of the article by the special service.

5. The assembly of claim 1 wherein the auxiliary label corresponds to an address label for the delivery of the article by the special service.

6. The assembly of claim 1 further comprising:

a special services designator section on the assembly.

7. The assembly of claim 1 further comprising:

a receipt; and a special services designator section wherein the receipt is removably attached to the special services designator section.

8. The assembly of claim 1 further comprising:

a second sheet attached to the first sheet wherein the second sheet contains a second label for attachment to a second return postcard.

9. A form for special service delivery of a mailpiece, the form comprising:

a first layer having an information section for attachment to a special services return postcard wherein the information section has information related to delivery by a first special service and a second special service wherein the first special service is distinct from the second special service and further wherein the information section is removably attached to the form;

a backing layer disposed on a backside of the first layer;

a first special services designator section on the form; and a second special services designator section on the form.

10. The form of claim 9 further comprising:

an auxiliary label removably attached to the backing sheet.

11. The form of claim 9 wherein the information section is removably attached to the backing sheet.

12. The form of claim 9 further comprising:

a receipt section removably attached to the first layer of the form.

13. The form of claim 10 wherein the information section includes an area for designating the special service delivery desired by a sender of the mailpiece.

14. The form of claim 9 wherein the first special services designator section is removably attached to the backing sheet.

15. The form of claim 9 further comprising:

an adhesive between the first layer and the backing sheet.

16. The form of claim 12 wherein the first special services designator section is removably attached to the receipt section via a tear line.

17. A method for preparing a mailpiece for delivery by a special service, the method comprising the steps of:

providing a form having a first layer wherein the first layer has a return postcard information section wherein the return postcard information section includes information related to delivery by a first special service and a second special service and wherein the first special service is distinct from the second special service;

providing a backing layer on a backside of the first layer wherein the information section is removably attached to the backing layer;

printing information related to the delivery of the mailpiece by the special service on the first layer;

providing a return postcard;

removing the information section from the form;

attaching the information section to the return postcard; and attaching the return postcard to a mailpiece.

18. The method of claim 17 further comprising the steps of:

providing an auxiliary label removably attached to the backing sheet; and removing the auxiliary label from the backing sheet.

19. The method of claim 18 further comprising the step of:

attaching the auxiliary label to the mailpiece to effect delivery of the mailpiece by the special service.

20. The method of claim 17 further comprising the step of:

providing a special services designator section on the form;

removing the special services designator section from the form; and attaching the special services designator section to the mailpiece to effect delivery of the mailpiece by the special service.

* * * * *

UNITED STATES PATENT AND TRADEMARK OFFICE

CERTIFICATE OF CORRECTION

PATENT NO. : 6,361,077 B1
DATED : March 26, 2002
INVENTOR(S) : Petkovsek

It is certified that error appears in the above-identified patent and that said Letters Patent is hereby corrected as shown below:

Column 7,
Line 21, change “printer” to read -- printed --
Line 46, change “typing” to read -- tying --

Column 9,
Line 7, change “118 o other” to read -- 118 or other --
Line 59, change “adjacent top” to read -- adjacent to --

Column 10,
Line 55, change “213 ad a” to read -- 213 as a --

Column 11,
Line 64, change “embodiment, the return postcard” to read -- embodiment, --

Signed and Sealed this

Thirtieth Day of September, 2003

JAMES E. ROGAN
*Director of the United States Patent and Trademark Office*